US011663961B2

(12) United States Patent
Liu

(10) Patent No.: US 11,663,961 B2
(45) Date of Patent: May 30, 2023

(54) PIXEL CIRCUIT, PIXEL DRIVING METHOD AND DISPLAY DEVICE

(71) Applicant: BOE Technology Group Co., Ltd., Beijing (CN)

(72) Inventor: Dongni Liu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/771,739

(22) PCT Filed: May 25, 2021

(86) PCT No.: PCT/CN2021/095721
§ 371 (c)(1),
(2) Date: Apr. 25, 2022

(87) PCT Pub. No.: WO2021/238897
PCT Pub. Date: Dec. 2, 2021

(65) Prior Publication Data

US 2023/0073465 A1 Mar. 9, 2023

(30) Foreign Application Priority Data

May 25, 2020 (CN) ..... 202010448420.1

(51) Int. Cl.
*G09G 3/32* (2016.01)

(52) U.S. Cl.
CPC ..... *G09G 3/32* (2013.01); *G09G 2300/0842* (2013.01); *G09G 2310/027* (2013.01); *G09G 2310/0267* (2013.01)

(58) Field of Classification Search
CPC ..... G09G 2300/0842; G09G 3/32; G09G 2310/0267; G09G 2310/027
See application file for complete search history.

(56) References Cited

U.S. PATENT DOCUMENTS 9,728,154 B2 8/2017 Kim et al.
10,262,596 B2 4/2019 Sano et al.
(Continued)

FOREIGN PATENT DOCUMENTS

CN 107068057 A 8/2017
CN 107731167 A 2/2018
(Continued)

OTHER PUBLICATIONS

CN 202010448420.1 first office action.
PCT/CN2021/095721 international search report and written opinion.

*Primary Examiner* — Muhammad N Edun
(74) *Attorney, Agent, or Firm* — IPro, PLLC

(57) ABSTRACT

A pixel circuit, a pixel driving method and a display device are provided. The pixel circuit includes a driving circuit, a first light-emitting control circuit and a light-emitting circuit; the light-emitting circuit includes a path control sub-circuit, a first light-emitting sub-circuit, a first light-emitting element, a second light-emitting sub-circuit and a second light-emitting element; a path control sub-circuit controls to write a second data voltage on a second data line into the control terminal, and maintains a potential of the control terminal; a first light-emitting sub-circuit connects the writing node to or disconnects the writing node from the first light-emitting element under the control of the potential of the control terminal; the second light-emitting sub-circuit electrically connects the writing node to or electrically disconnects the writing node from the second light-emitting element under the control of the potential of the control terminal and the second light-emitting control signal.

20 Claims, 10 Drawing Sheets

(56) References Cited

U.S. PATENT DOCUMENTS

| | | | | |
|---|---|---|---|---|
| 2016/0210892 | A1* | 7/2016 | Ohara | G09G 3/2022 |
| 2017/0039934 | A1* | 2/2017 | Ma | G09G 3/3233 |
| 2017/0200415 | A1* | 7/2017 | Noguchi | H10K 50/11 |
| 2018/0357961 | A1 | 12/2018 | Yang et al. | |
| 2019/0244559 | A1* | 8/2019 | Cho | G09G 3/3208 |
| 2019/0279565 | A1 | 9/2019 | Yang et al. | |
| 2019/0362667 | A1 | 11/2019 | Ma et al. | |

FOREIGN PATENT DOCUMENTS

| | | | |
|---|---|---|---|
| CN | 108417149 | A | 8/2018 |
| CN | 109003574 | A | 12/2018 |
| CN | 110047425 | A | 7/2019 |
| CN | 111477166 | A | 7/2020 |
| KR | 20150093909 | A | 8/2015 |

* cited by examiner

PIXEL CIRCUIT, PIXEL DRIVING METHOD AND DISPLAY DEVICE

CROSS-REFERENCE TO RELATED APPLICATIONS

This application is the U.S. national phase of PCT Application No. PCT/CN2021/095721 filed on May 25, 2021, which claims priority to Chinese Patent Application No. 202010448420.1 filed in China on May 25, 2020, the entire contents of which are hereby incorporated by reference.

TECHNICAL FIELD

The present disclosure relates to a technical field of displaying, and more particular to a pixel circuit, a pixel driving method and a display device.

BACKGROUND

A Micro-Light Emitting Diode (Micro-LED)/Mini-LED will be widely used in the future display field because of its high brightness and high reliability. As a self-luminous device, the luminous efficiency, the brightness, and the color coordinates of the Micro-LED/Mini-LED will change at low current density with the current density. Therefore, the Micro-LED/Mini-LED needs to achieve a grayscale display at a high current density, i.e., a high current. In related art, the current control driving circuit cannot achieve the driving of a high voltage and a low grayscale independently, and cannot satisfy both a long duration light-emitting driving of the high grayscale and a high current driving of the low grayscale.

After the Micro-LED/Mini-LED is formed on the wafer, it is soldered onto the backplate by transfer printing. However, due to the large quantity of transfer printing chips, the defect of dark spots is still serious, which adversely affects the display of the Micro-LED/Mini-LED.

SUMMARY

The present disclosure provides a pixel circuit including a driving circuit, a first light-emitting control circuit and a light-emitting circuit, wherein the driving circuit is electrically connected to a first data line and a first gate line respectively for generating, under control of a first gate driving signal provided by the first gate line, a driving current according to a first data voltage on the first data line;

the first light-emitting control circuit is electrically connected to the first light-emitting control line, the driving current output terminal and the writing node of the driving circuit, and configured for controlling to electrically connect the driving current output terminal to the writing node or electrically disconnect the driving current output terminal from the writing node under the control of a first light-emitting control signal provided by the first light-emitting control line;

the light-emitting circuit includes a path control sub-circuit, a first light-emitting sub-circuit, a first light-emitting element, a second light-emitting sub-circuit and a second light-emitting element;

the path control sub-circuit is electrically connected to a second gate line, a second data line and a control terminal, and configured for controlling, under control of a second gate driving signal provided by the second gate line, to write a second data voltage on the second data line into the control terminal, and maintaining the potential of the control terminal;

the first light-emitting sub-circuit is electrically connected to the control terminal, the writing node and the first light-emitting element, and configured for electrically connecting the writing node to the first light-emitting element or electrically disconnecting the writing node from the first light-emitting element under the control of the potential of the control terminal; and the second light-emitting sub-circuit is electrically connected to the writing node, the second light-emitting element, the control terminal and the second light-emitting control line, and configured for electrically connecting the writing node to the second light-emitting element or electrically disconnecting the writing node from the second light-emitting element under the control of the potential of the control terminal and a second light-emitting control signal provided by the second light-emitting control line.

Optionally, the path control sub-circuit includes a path controlling transistor and a maintaining capacitor;

a control electrode of the path controlling transistor is electrically connected to a second gate line, a first electrode of the path controlling transistor is electrically connected to the control terminal, and a second electrode of the path controlling transistor is electrically connected to the second data line; and a first terminal of the maintaining capacitor is electrically connected to the control terminal, and a second terminal of the maintaining capacitor is electrically connected to a reference voltage input terminal.

Optionally, the first light-emitting sub-circuit includes a first display control transistor; and the control electrode of the first display control transistor is electrically connected to the control terminal, a first electrode of the first display control transistor is electrically connected to the writing node, and the second electrode of the first display control transistor is electrically connected to the first light-emitting element.

Optionally, the second light-emitting sub-circuit includes a second display control transistor and a third display control transistor, wherein the control electrode of the second display control transistor is electrically connected to the control terminal, and a first electrode of the second display control transistor is electrically connected to the writing node; and the control electrode of the third display control transistor is electrically connected to the second light-emitting control line, a first electrode of the third display control transistor is electrically connected to the second electrode of the second display control transistor, and the second electrode of the third display control transistor is electrically connected to the second light-emitting element.

Optionally, the driving circuit includes a driving sub-circuit, a data writing sub-circuit, a light-emitting control sub-circuit, a compensation sub-circuit and an energy storage sub-circuit;

the data writing sub-circuit is electrically connected to the first gate line, the first data line and the first terminal of the driving sub-circuit, and configured for controlling to write the first data voltage into the first terminal of the driving sub-circuit under the control of the first gate driving signal;

the light-emitting control sub-circuit is electrically connected to a first light-emitting control line, a supply-voltage terminal and the first terminal of the driving sub-circuit, and configured for electrically connecting the supply-voltage terminal to the first terminal of the driving sub-circuit or electrically disconnecting the supply-voltage terminal from the first terminal of the driving sub-circuit under the control of the first light-emitting control signal;

the first terminal of the energy storage sub-circuit is electrically connected to the control terminal of the driving sub-circuit, and a second terminal of the energy storage sub-circuit is electrically connected to the supply-voltage terminal;

a second terminal of the driving sub-circuit is electrically connected to the driving current output terminal, and the driving sub-circuit is configured for electrically connecting the first terminal of the driving sub-circuit to the driving current output terminal or electrically disconnecting the first terminal of the driving sub-circuit from the driving current output terminal under the control of the potential of the control terminal of the driving sub-circuit; and the compensation sub-circuit is electrically connected to the first gate line, the control terminal of the driving sub-circuit and the second terminal of the driving sub-circuit, and configured for electrically connecting the control terminal of the driving sub-circuit to the second terminal of the driving sub-circuit or electrically disconnecting the control terminal of the driving sub-circuit from the second terminal of the driving sub-circuit under the control of the first gate driving signal.

Optionally, the driving circuit further includes an initial sub-circuit; and the initial sub-circuit is electrically connected to a reset terminal, the control terminal of the driving sub-circuit and an initialization voltage terminal, and configured for writing an initialization voltage provided by the initialization voltage terminal into the control terminal of the driving sub-circuit under the control of a reset control signal provided by the reset terminal.

Optionally, the first light-emitting control circuit includes a first light-emitting control transistor, the light-emitting control sub-circuit includes a second light-emitting control transistor, the driving sub-circuit includes a driving transistor, the data writing sub-circuit includes a data writing transistor, and the compensation sub-circuit includes a compensating transistor; the energy storage sub-circuit includes storage capacitor;

the control electrode of the first light-emitting control transistor is electrically connected to the first light-emitting control line, the first electrode of the first light-emitting control transistor is electrically connected to the driving current output terminal, and the second electrode of the first light-emitting control transistor is electrically connected to the writing node;

the control electrode of the second light-emitting control transistor is electrically connected to the first light-emitting control line, the first electrode of the first light-emitting control transistor is electrically connected to the supply-voltage terminal, and the second electrode of the first light-emitting control transistor is electrically connected to the first electrode of the driving transistor;

the control electrode of the data writing transistor is electrically connected to the first gate line, the first electrode of the data writing transistor is electrically connected to the first data line, and the second electrode of the data writing transistor is electrically connected to the first electrode of the driving transistor;

the control electrode of the compensating transistor is electrically connected to the first gate line, the first electrode of the compensating transistor is electrically connected to the control electrode of the driving transistor, and the second electrode of the compensating transistor is electrically connected to the second electrode of the driving transistor;

the second electrode of the driving transistor is electrically connected to the driving current output terminal; and the first terminal of the storage capacitor is electrically connected to the control electrode of the driving transistor, and the second terminal of the storage capacitor is electrically connected to the supply-voltage terminal.

Optionally, the initial sub-circuit includes an initial transistor; the control electrode of the initial transistor is electrically connected to the reset terminal, the first electrode of the initial transistor is electrically connected to the initialization voltage terminal, and the second electrode of the initial transistor is electrically connected to the control terminal of the driving sub-circuit.

The present disclosure also provides a pixel driving method, which is applied to the above-mentioned pixel circuit, the pixel driving method including:

a driving circuit generating, under control of a first gate driving signal provided by the first gate line, a driving current according to a first data voltage on the first data line;

a first light-emitting control circuit controlling to electrically connect the driving current output terminal to the writing node or electrically disconnect the driving current output terminal from the writing node under the control of a first light-emitting control signal provided by a first light-emitting control line;

a path control sub-circuit writing a second data voltage on a second data line into a control terminal under the control of a second gate driving signal provided by a second gate line, and maintaining the potential of the control terminal;

a first light-emitting sub-circuit electrically connecting the writing node to the first light-emitting element or electrically disconnecting the writing node from the first light-emitting element under the control of the potential of the control terminal; and a second light-emitting sub-circuit electrically connecting the writing node to the second light-emitting element or electrically disconnecting the writing node from the second light-emitting element under the control of the potential of the control terminal and a second light-emitting control signal provided by the second light-emitting control line.

Optionally, a display period includes data writing stage and light-emitting stage which are arranged in sequence;

the pixel driving method includes: in the high grayscale display mode:

during the data writing stage, the driving circuit receiving a first data voltage under the control of a first gate driving signal; a path control sub-circuit writing a second data voltage into the control terminal under the control of a second gate driving signal; a first light-emitting control circuit disconnecting the driving current output terminal from the writing node under the control of the first light-emitting control signal;

during the light-emitting stage, the driving circuit generating a driving current according to the first data voltage, and the first light-emitting control circuit electrically connecting the driving current output terminal to the writing node under the control of the first light-emitting control signal; the path control sub-circuit maintaining the potential of the control terminal, a first light-emitting sub-circuit electrically connecting the writing node to the first light-emitting element under the control of the potential of the control terminal, and the driving circuit driving the first light-emitting element to emit light; a second light-emitting sub-circuit disconnecting the writing node from the second light-emitting element under the control of the potential of the control terminal and the second light-emitting control signal;

the pixel driving method further includes: in low grayscale display mode:

during the data writing stage, the driving circuit receiving a first data voltage under the control of a first gate driving signal; a path control sub-circuit writing a second data voltage into the control terminal under the control of a second gate driving signal; a first light-emitting control circuit disconnecting the driving current output terminal from the writing node under the control of the first light-emitting control signal; and during the light-emitting stage, the driving circuit generating a driving current according to the first data voltage, and the first light-emitting control circuit electrically connecting the driving current output terminal to the writing node under the control of the first light-emitting control signal; the path control sub-circuit maintaining the potential of the control terminal, and a first light-emitting sub-circuit disconnecting the writing node from the first light-emitting element under the control of the potential of the control terminal; a second light-emitting sub-circuit electrically connecting the writing node to the second light-emitting element under the control of the potential of the control terminal and the second light-emitting control signal, and the driving circuit driving the second light-emitting element to emit light.

Optionally, the display period further includes a light-extinguishing stage arranged after the light-emitting stage; and during the light-extinguishing stage, a second light-emitting control circuit disconnects connection between the writing node and the second light-emitting element under the control of the potential of the control terminal and the second light-emitting control signal, and the second light-emitting element stops emitting light.

Optionally, a display period includes data writing stage and light-emitting stage which are arranged in sequence;

the pixel driving method includes: when the first light-emitting element is used for emitting light, during the data writing stage, a driving circuit receiving a first data voltage under the control of a first gate driving signal; a path control sub-circuit writing a second data voltage into the control terminal under the control of a second gate driving signal; a first light-emitting control circuit disconnecting the driving current output terminal from the writing node under the control of the first light-emitting control signal;

during the light-emitting stage, the driving circuit generating a driving current according to the first data voltage, and the first light-emitting control circuit electrically connecting the driving current output terminal to the writing node under the control of the first light-emitting control signal; the path control sub-circuit maintaining the potential of the control terminal, a first light-emitting sub-circuit electrically connecting the writing node to the first light-emitting element under the control of the potential of the control terminal, and the driving circuit driving the first light-emitting element to emit light; a second light-emitting sub-circuit disconnecting the writing node from the second light-emitting element under the control of the potential of the control terminal and the second light-emitting control signal;

the pixel driving method further includes: when the second light-emitting element is used for emitting light, during the data writing stage, a driving circuit receiving a first data voltage under the control of a first gate driving signal; a path control sub-circuit writing a second data voltage into the control terminal under the control of a second gate driving signal; a first light-emitting control circuit disconnecting the driving current output terminal from the writing node under the control of the first light-emitting control signal; and during the light-emitting stage, the driving circuit generating a driving current according to the first data voltage, and the first light-emitting control circuit electrically connecting the driving current output terminal to the writing node under the control of the first light-emitting control signal; the path control sub-circuit maintaining the potential of the control terminal, and a first light-emitting sub-circuit disconnecting the writing node from the first light-emitting element under the control of the potential of the control terminal; a second light-emitting sub-circuit electrically connecting the writing node to the second light-emitting element under the control of the potential of the control terminal and the second light-emitting control signal, and the driving circuit driving a second light-emitting element to emit light.

The present disclosure also provides a display device, including the pixel circuit described above.

DETAILED DESCRIPTION

Figure 1:
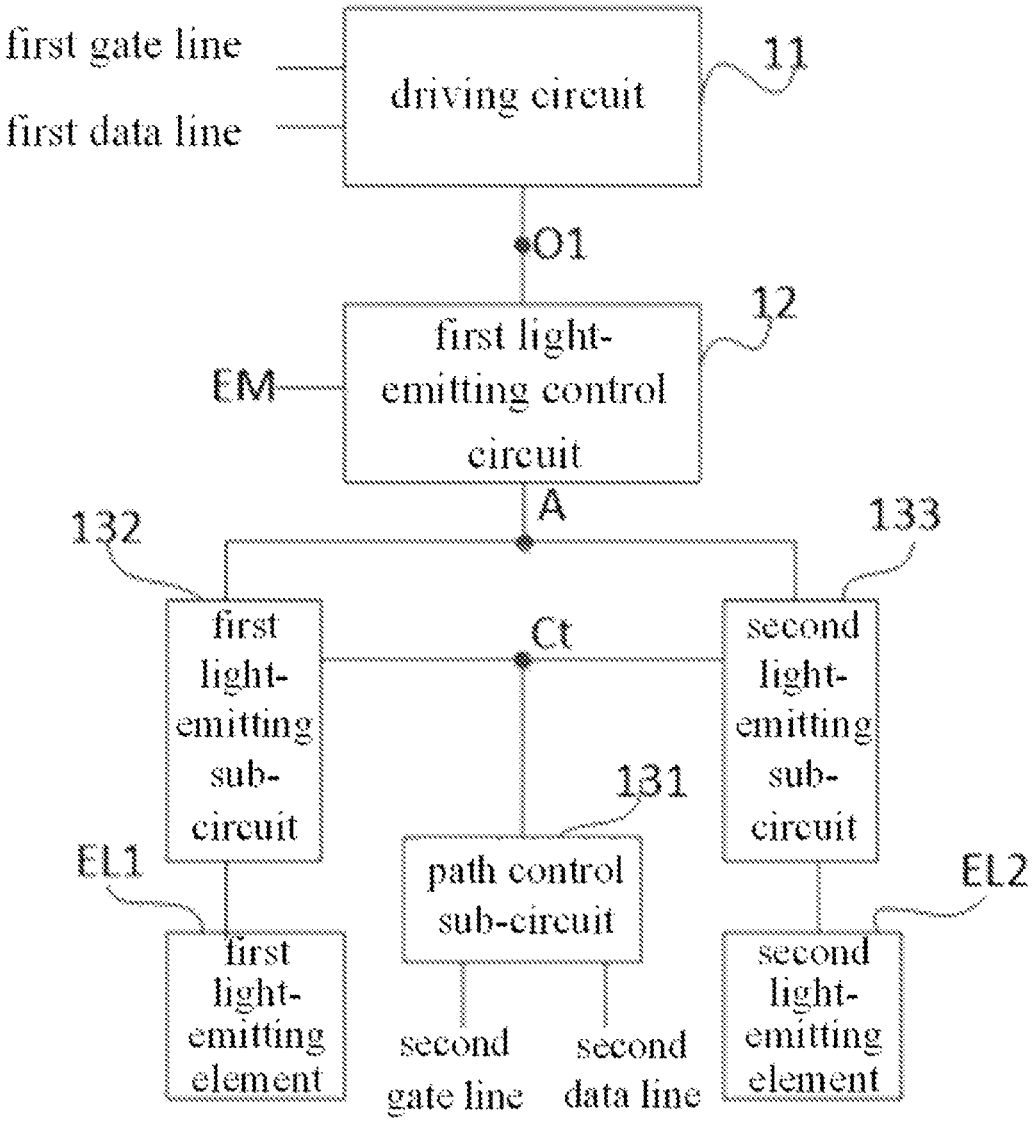
FIG. 1 is a structure diagram of a pixel circuit according to an embodiment of the present disclosure.

The technical solution in the embodiment of the present disclosure will be clearly and completely described below in conjunction with the drawings in the embodiment of the present disclosure. It is apparent that the described embodiments are not all embodiments but part of embodiments of the present disclosure. Based on the embodiments in the present disclosure, all other embodiments obtained by a person of ordinary skill in the art without inventive effort are within the scope of protection of the present disclosure.

A Micro-Light Emitting Diode (Micro-LED)/Mini-LED will be widely used in the future display field because of its high brightness and high reliability. As a self-luminous device, the luminous efficiency, the brightness, and the color coordinates of the Micro-LED/Mini-LED will change at low current density with the current density. Therefore, the Micro-LED/Mini-LED needs to achieve a grayscale display at a high current density, i.e., a high current. In related art, the current control driving circuit cannot achieve the driving of a high voltage and a low grayscale independently, and cannot satisfy both a long duration light-emitting driving of the high grayscale and a high current driving of the low grayscale.

After the Micro-LED/Mini-LED is formed on the wafer, it is soldered onto the backplate by transfer printing. The backplate provides the current driving circuit; the Micro-LED/Mini-LED is soldered on the cathode of pixel and the anode of pixel; the current flows through the Micro-LED/Mini-LED, so that the Micro-LED/Mini-LED emits light to achieve the display function. However, in order to meet the display requirements of high resolution and high Pixels Per Inch (PPI), the quantity of the micro-LEDs/Mini-LEDs subjected to transfer printing is very large, and NG (failure) of transfer printing or damage of light emitting diode (LED) chip will result in the defect of display dark spot. Even if the yield of transfer printing is high, the defect of the dark spots is still serious due to the large quantity of transfer printing chips, which adversely affects the display of the Micro-LED/Mini-LED.

The transistor employed in all embodiments of the present disclosure may be a triode, a thin film transistor or a field effect transistor or other devices of the same nature. In the embodiment of the present disclosure, in order to distinguish between two electrodes of a transistor other than control electrode, one of the electrodes is referred to as a first electrode and the other electrode is referred to as a second electrode.

In actual implementation, when the transistor is a triode, the control electrode may be a base electrode, the first electrode may be a collector electrode, and the second electrode may be an emitter electrode; alternatively, the control electrode may be a base electrode, the first electrode may be an emitter electrode, and the second electrode may be a collector electrode.

In actual implementation, when the transistor is a thin film transistor or a field effect transistor, the control electrode may be a gate electrode, the first electrode may be a drain electrode, and the second electrode may be a source electrode; alternatively, the control electrode may be a gate electrode, the first electrode may be a source electrode, and the second electrode may be a drain electrode.

As shown in FIG. 1, the pixel circuit according to the embodiment of the present disclosure includes a driving circuit 11, a first light-emitting control circuit 12, and a light-emitting circuit, wherein the driving circuit 11 is electrically connected to the first data line Data_I and the first gate line Gate_A for generating a driving current according to the first data voltage on the first data line Data_I under the control of the first gate driving signal provided by the first gate line Gate_A;

the first light-emitting control circuit 12 is electrically connected to the first light-emitting control line EM, the driving current output terminal O1 of the driving circuit 11 and the writing node A, and configured for controlling to electrically connect the driving current output terminal O1 to the writing node A or electrically disconnect the driving current output terminal O1 from the writing node A under the control of the first light-emitting control signal provided by the first light-emitting control line EM;

the light-emitting circuit includes a path control sub-circuit 131, a first light-emitting sub-circuit 132, a first light-emitting element EL1, a second light-emitting sub-circuit 133 and a second light-emitting element EL2;

the path control sub-circuit 131 is electrically connected to the second gate line Gate_B, the second data line Data_T and the control terminal Ct, and configured for controlling to write the second data voltage on the second data line Data_T into the control terminal Ct and maintaining the potential of the control terminal Ct under the control of the second gate driving signal provided by the second gate line Gate_B;

the first light-emitting sub-circuit 132 is electrically connected to the control terminal Ct, the writing node A and the first light-emitting element EL1, and configured for electrically connecting the writing node A to the first light-emitting element EL1 or electrically disconnecting the writing node A from the first light-emitting element EL1 under the control of the potential of the control terminal Ct; and the second light-emitting sub-circuit 133 is electrically connected to the writing node A, the second light-emitting element EL2, the control terminal Ct and the second light-emitting control line EML, and configured for electrically connecting the writing node A to the second light-emitting element EL2 or electrically disconnecting the writing node A from the second light-emitting element EL2 under the control of the potential of the control terminal Ct and the second light-emitting control signal provided by the second light-emitting control line EML.

In the embodiment of the present disclosure, the first light-emitting element EL1 may be a Micro-LED or a Mini LED, and the second light-emitting element EL2 may be a Micro-LED or a Mini LED, but the present disclosure is not limited thereto.

The pixel circuit described in the embodiment of the present disclosure can implement the driving of the high grayscale voltage and the driving of the low grayscale voltage independently through the current control and the time duration control, satisfying both long duration driving with respect to the high grayscale and high current driving with respect to the low grayscale; furthermore, the pixel circuit described in the embodiment of the present disclosure is of a redundant driving circuit design, so that when one of the light-emitting elements cannot emit light properly, the other light-emitting element can still emit light properly, thereby reducing the dark point defect and improving the backplate yield.

The pixel circuit described in the embodiment of the present disclosure can use a current plus light-emitting duration control mode to drive a corresponding light-emitting element to emit light through different light-emitting sub-circuits at the high grayscale and at the low grayscale respectively, wherein the light-emitting durations of the light-emitting sub-circuits do not affect each other, and the maximum light-emitting duration for the high grayscale is provided, which reduces power consumption; the light-emitting duration for the low grayscale can be controlled by the second light-emitting control line EML without adversely affecting the light-emitting duration for the high grayscale.

The pixel circuit described in embodiment of the present disclosure is a light-emitting element redundant circuit, so that when one of the light-emitting elements cannot emit light properly, the other light-emitting element can still emit light properly, thereby improving the backplate yield.

The pixel circuit described in embodiment of the present disclosure is of the design of dual gate lines, dual data lines, dual light-emitting control lines and the light-emitting element redundancy, to achieve the driving controls for the high and low grayscales respectively, and improve the backplate yield.

During the operation of the pixel circuit described in embodiment of the present disclosure, the display period includes a data writing stage and a light-emitting stage arranged in sequence; under high grayscale display mode:

during the data writing stage, the driving circuit 11 receives a first data voltage under the control of a first gate driving signal; the path control sub-circuit 131 writes a second data voltage into the control terminal Ct under the control of a second gate driving signal; a first light-emitting control circuit 12 electrically disconnects the driving current output terminal O1 from the writing node A under the control of the first light-emitting control signal; and during the light-emitting stage, the driving circuit 11 generates a driving current according to the first data voltage, and the first light-emitting control circuit 12 electrically connects the driving current output terminal O1 to the writing node A under the control of the first light-emitting control signal; the path control sub-circuit 131 maintains the potential of the control terminal Ct; the first light-emitting sub-circuit 132 electrically connects the writing node A to the first light-emitting element EL1 under the control of the potential of the control terminal Ct; the driving circuit 11 drives the first light-emitting element EL1 to emit light; the second light-emitting sub-circuit 133 electrically disconnects the writing node A from the second light-emitting element EL2 under control of the potential of the control terminal Ct and the second light-emitting control signal.

During the operation of the pixel circuit described in embodiment of the present disclosure, in the high grayscale display mode, the first light-emitting sub-circuit 132 electrically connects the writing node to the first light-emitting element EL1, and the driving circuit 11 drives the first light-emitting element EL1 to emit light in the light-emitting stage; in the high grayscale display mode; in the embodiment of the present disclosure, it combines the high driving current and the high light-emitting duration to reduce backplate power consumption, and achieve the high grayscale display.

During the operation of the pixel circuit described in embodiment of the present disclosure, the display period may include the data writing stage, the light-emitting stage and the light-extinguishing stage which are arranged in sequence; in low grayscale display mode:

during the data writing stage, the driving circuit 11 receives the first data voltage under the control of the first gate driving signal; the path control sub-circuit 131 writes the second data voltage into the control terminal under the control of the second gate driving signal; the first light-emitting control circuit 12 electrically disconnects the driving current output terminal O1 from the writing node A under the control of the first light-emitting control signal;

during the light-emitting stage, the driving circuit 11 generates the driving current according to the first data voltage, and the first light-emitting control circuit 12 electrically connects the driving current output terminal O1 to the writing node A under the control of the first light-emitting control signal; the path control sub-circuit 131 maintains the potential of the control terminal Ct, and the first light-emitting sub-circuit 132 electrically disconnects the writing node A from the first light-emitting element EL1 under the control of the potential of the control terminal Ct; the second light-emitting sub-circuit 133 electrically connects the writing node A to the second light-emitting element EL2 under the control of the potential of the control terminal Ct and the second light-emitting control signal, and the driving circuit 11 drives the second light-emitting element EL2 light-emitting; and in the light-extinguishing stage, the second light-emitting control circuit 12 electrically disconnects the writing node A from the second light-emitting element EL2 under the control of the potential of the control terminal and the second light-emitting control signal, and the second light-emitting element EL2 stops emitting light.

The duration of the light-emitting stage in the low grayscale display mode is less than the duration of the light-emitting stage in the high grayscale display mode, and the embodiment of the present disclosure achieves the low grayscale display by combining the high driving current with the low light-emitting duration, so as to achieve the low grayscale display with the high driving current.

Furthermore, in the pixel circuit described in the embodiment of the present disclosure, the light-emitting circuit includes the path control sub-circuit 131, the first light-emitting sub-circuit 132, the first light-emitting element EL1, the second light-emitting sub-circuit 133 and the second light-emitting element EL2. The pixel circuit described in the embodiment of the present disclosure is of a redundant driving circuit design, so that when one of the light-emitting elements cannot emit light properly, the other light-emitting element can still emit light properly, thereby reducing the dark point defect and improving the backplate yield.

In the embodiment of the present disclosure, one sub-pixel may subject two LED chips to transfer printing, wherein when one of the LED chips is abnormal, the other LED chip can still normally emit light.

During the operation of the pixel circuit described in embodiment of the present disclosure, the display period may include the data writing stage and the light-emitting stage which are arranged in sequence; when the second light-emitting element cannot emit light properly, during the data writing stage, the driving circuit 11 receives the first data voltage under the control of the first gate driving signal; the path control sub-circuit 131 writes the second data voltage into the control terminal Ct under the control of the second gate driving signal; the first light-emitting control circuit 12 electrically disconnects the driving current output terminal O1 from the writing node A under the control of the first light-emitting control signal; and during the light-emitting stage, the driving circuit 11 generates the driving current according to the first data voltage, and the first light-emitting control circuit 12 electrically connects the driving current output terminal O1 to the writing node A under the control of the first light-emitting control signal; the path control sub-circuit 131 maintains the potential of the control terminal Ct; the first light-emitting sub-circuit 132 electrically connects the writing node A to the first light-emitting element EL1 under the control of the potential of the control terminal Ct; the driving circuit 11 drives the first light-emitting element EL1 to emit light; the second light-emitting sub-circuit 133 electrically disconnects the writing node A from the second light-emitting element EL2 under the control of the potential of the control terminal Ct and the second light-emitting control signal.

During the operation of the pixel circuit described in embodiment of the present disclosure, the display period may include the data writing stage and the light-emitting stage which are arranged in sequence; when the first light-emitting element cannot emit light properly, in the data writing stage, the driving circuit 11 receives the first data voltage under the control of the first gate driving signal; the path control sub-circuit 131 writes the second data voltage into the control terminal Ct under the control of the second gate driving signal; the first light-emitting control circuit 12 electrically disconnects the driving current output terminal O1 from the writing node A under the control of the first light-emitting control signal; and during the light-emitting stage, the driving circuit 11 generates the driving current according to the first data voltage, and the first light-emitting control circuit 12 electrically connects the driving current output terminal O1 to the writing node A under the control of the first light-emitting control signal; the path control sub-circuit 131 maintains the potential of the control terminal Ct, and the first light-emitting sub-circuit 132 electrically disconnects the writing node A from the first light-emitting element EL1 under the control of the potential of the control terminal Ct; the second light-emitting sub-circuit 133 electrically connects the writing node A to the second light-emitting element EL2 under the control of the potential of the control terminal Ct and the second light-emitting control signal, and the driving circuit 11 drives the second light-emitting element EL2 to emit light.

In actual implementation, the path control sub-circuit may include a path controlling transistor and a maintaining capacitor;

a control electrode of the path controlling transistor is electrically connected to a second gate line, a first electrode of the path controlling transistor is electrically connected to the control terminal, and a second electrode of the path controlling transistor is electrically connected to the second data line; and a first terminal of the maintaining capacitor is electrically connected to the control terminal, and a second terminal of the maintaining capacitor is electrically connected to a reference voltage input terminal.

In the embodiment of the present disclosure, the first light-emitting sub-circuit may include a first display control transistor; and a control electrode of the first display control transistor is electrically connected to the control terminal, a first electrode of the first display control transistor is electrically connected to the writing node, and a second electrode of the first display control transistor is electrically connected to the first light-emitting element.

In the embodiment of the present disclosure, the second light-emitting sub-circuit may include a second display control transistor and a third display control transistor, wherein a control electrode of the second display control transistor is electrically connected to the control terminal, and a first electrode of the second display control transistor is electrically connected to the writing node; and a control electrode of the third display control transistor is electrically connected to the second light-emitting control line, a first electrode of the third display control transistor is electrically connected to the second electrode of the second display control transistor, and a second electrode of the third display control transistor is electrically connected to the second light-emitting element.

Figure 2:
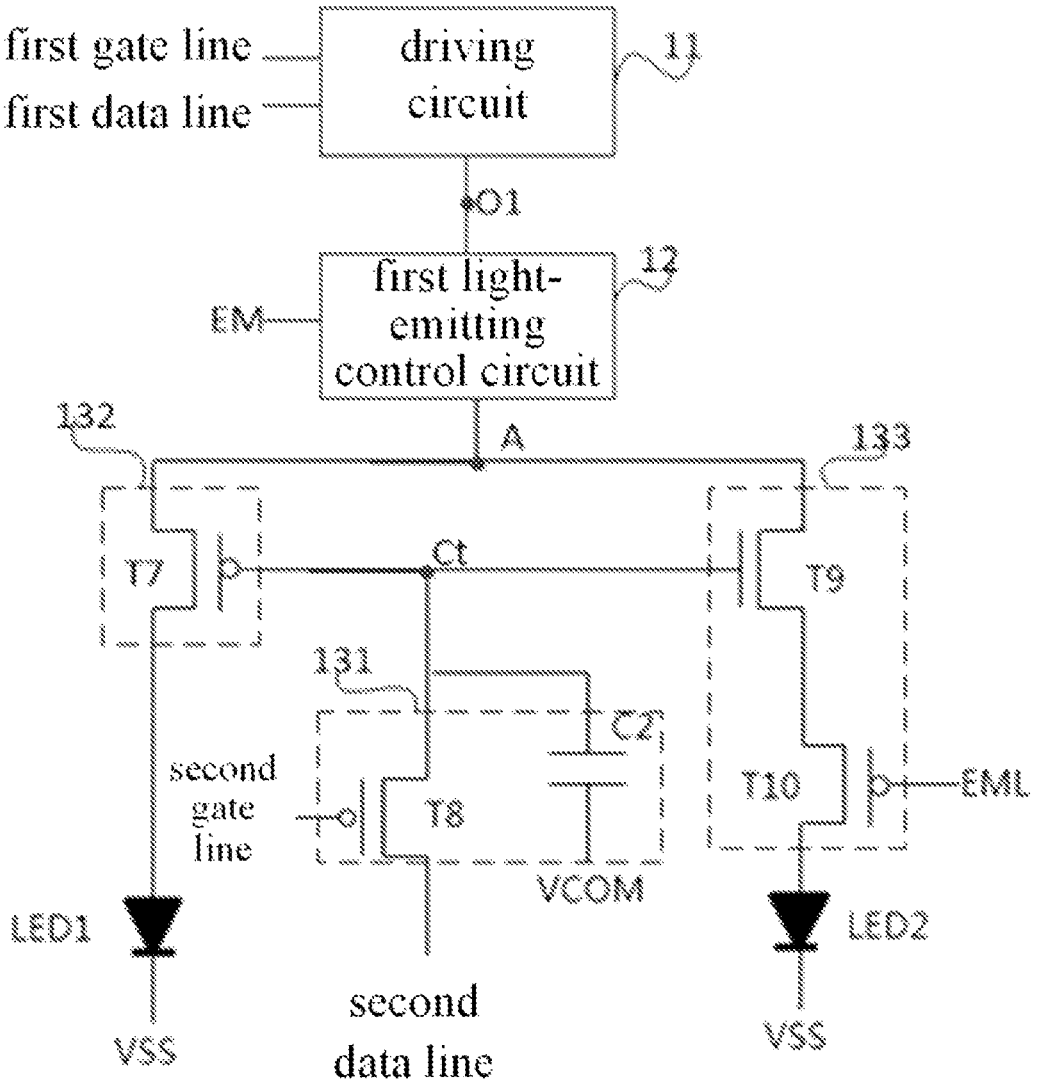
FIG. 2 is a structure diagram of a pixel circuit according to an embodiment of the present disclosure.

As shown in FIG. 2, on the basis of the embodiment of the pixel circuit shown in FIG. 1, the path control sub-circuit 131 may include a path controlling transistor T8 and a maintaining capacitor C2;

a gate electrode of the path controlling transistor T8 is electrically connected to a second gate line Gate_B, a source electrode of the path controlling transistor T8 is electrically connected to the control terminal Ct, and a drain electrode of the path controlling transistor T8 is electrically connected to the second data line Data_T;

the first terminal of the maintaining capacitor C2 is electrically connected to the control terminal Ct, and a second terminal of the maintaining capacitor C2 is electrically connected to a reference voltage input terminal; the reference voltage input terminal is configured for providing a reference voltage VCOM;

the first light-emitting sub-circuit 132 may include a first display control transistor T7; the first light-emitting element is a first mini light emitting diode LED1;

the gate electrode of the first display control transistor T7 is electrically connected to the control terminal Ct, the source electrode of the first display control transistor T7 is electrically connected to the writing node A, and the drain electrode of the first display control transistor T7 is electrically connected to the anode of the first mini light emitting diode LED1;

a low voltage VSS is inputted to a cathode of a first mini light emitting diode LED1;

the second light-emitting sub-circuit 133 includes a second display control transistor T9 and a third display control transistor T10; a second light-emitting element is a second mini light emitting diode LED2;

a gate electrode of the second display control transistor T9 is electrically connected to the control terminal Ct, and a drain electrode of the second display control transistor T9 is electrically connected to the writing node A;

a gate electrode of the third display control transistor T10 is electrically connected to the second light-emitting control line (EML), a source electrode of the third display control transistor T10 is electrically connected to the source electrode of the second display control transistor T9, and a drain electrode of the third display control transistor T10 is electrically connected to an anode of the second mini light emitting diode LED2; and the low voltage VSS is inputted into a cathode of the second mini light emitting diode LED2.

In the embodiment shown in FIG. 2, the first light-emitting element is a first mini light emitting diode LED1, and the second light-emitting element is a second mini light emitting diode LED2, but the present disclosure is not limited thereto.

In the embodiment shown in FIG. 2, T7, T8 and T10 are all PMOS transistors (P-type Metal-Oxide-Semiconductor field effect transistors) and T9 is an NMOS transistor (N-type Metal-Oxide-Semiconductor field effect transistor), but the present disclosure is not limited thereto.

Optionally, the driving circuit may include a driving sub-circuit, a data writing sub-circuit, a light-emitting control sub-circuit, a compensation sub-circuit and an energy storage sub-circuit;

the data writing sub-circuit is electrically connected to the first gate line, the first data line and the first terminal of the driving sub-circuit, and configured for controlling to write the first data voltage into the first terminal of the driving sub-circuit under the control of the first gate driving signal;

the light-emitting control sub-circuit is electrically connected to a first light-emitting control line, a supply-voltage terminal and the first terminal of the driving sub-circuit, and configured for electrically connecting the supply-voltage terminal to the first terminal of the driving sub-circuit or electrically disconnecting the supply-voltage terminal from the first terminal of the driving sub-circuit under the control of the first light-emitting control signal;

a first terminal of the energy storage sub-circuit is electrically connected to the control terminal of the driving sub-circuit, and a second terminal of the energy storage sub-circuit is electrically connected to the supply-voltage terminal;

a second terminal of the driving sub-circuit is electrically connected to the driving current output terminal, and the driving sub-circuit is configured for electrically connecting the first terminal of the driving sub-circuit to the driving current output terminal or electrically disconnecting the first terminal of the driving sub-circuit from the driving current output terminal under the control of the potential of the control terminal of the driving sub-circuit; and the compensation sub-circuit is electrically connected to the first gate line, the control terminal of the driving sub-circuit and the second terminal of the driving sub-circuit, and configured for electrically connecting the control terminal of the driving sub-circuit to the second terminal of the driving sub-circuit or electrically disconnecting the control terminal of the driving sub-circuit from the second terminal of the driving sub-circuit under the control of the first gate driving signal.

In the embodiment of the present disclosure, the driving circuit may include a driving sub-circuit, a data writing sub-circuit, a light-emitting control sub-circuit, a compensation sub-circuit and an energy storage sub-circuit, and the data writing sub-circuit writes the first voltage to the first terminal of the driving sub-circuit, the light-emitting control sub-circuit controls to electrically connect the supply-voltage terminal to the first terminal of the driving sub-circuit or electrically disconnect the supply-voltage terminal from the first terminal of the driving sub-circuit; the energy storage sub-circuit maintains the potential of the control terminal of the driving sub-circuit; and the compensation sub-circuit compensates for the threshold voltage of the driving transistor included in the driving sub-circuit by electrically connecting the control terminal of the driving sub-circuit to the second terminal of the driving sub-circuit or electrically disconnecting the control terminal of the driving sub-circuit from the second terminal of the driving sub-circuit, so that the driving current is independent to the threshold voltage of the driving transistor.

Optionally, the driving circuit may further include an initial sub-circuit;

the initial sub-circuit is electrically connected to a reset terminal, the control terminal of the driving sub-circuit and an initialization voltage terminal, and configured for writing an initialization voltage provided by the initialization voltage terminal into the control terminal of the driving sub-circuit under the control of a reset control signal provided by the reset terminal.

Optionally, the initial sub-circuit may write an initialization voltage to the control terminal of the driving sub-circuit at the initialization stage, so that upon the first gate line is turned on, the driving sub-circuit can connect its first terminal to its second terminal under the control of the potential of its control terminal, so as to implement the threshold voltage compensation.

Figure 3:
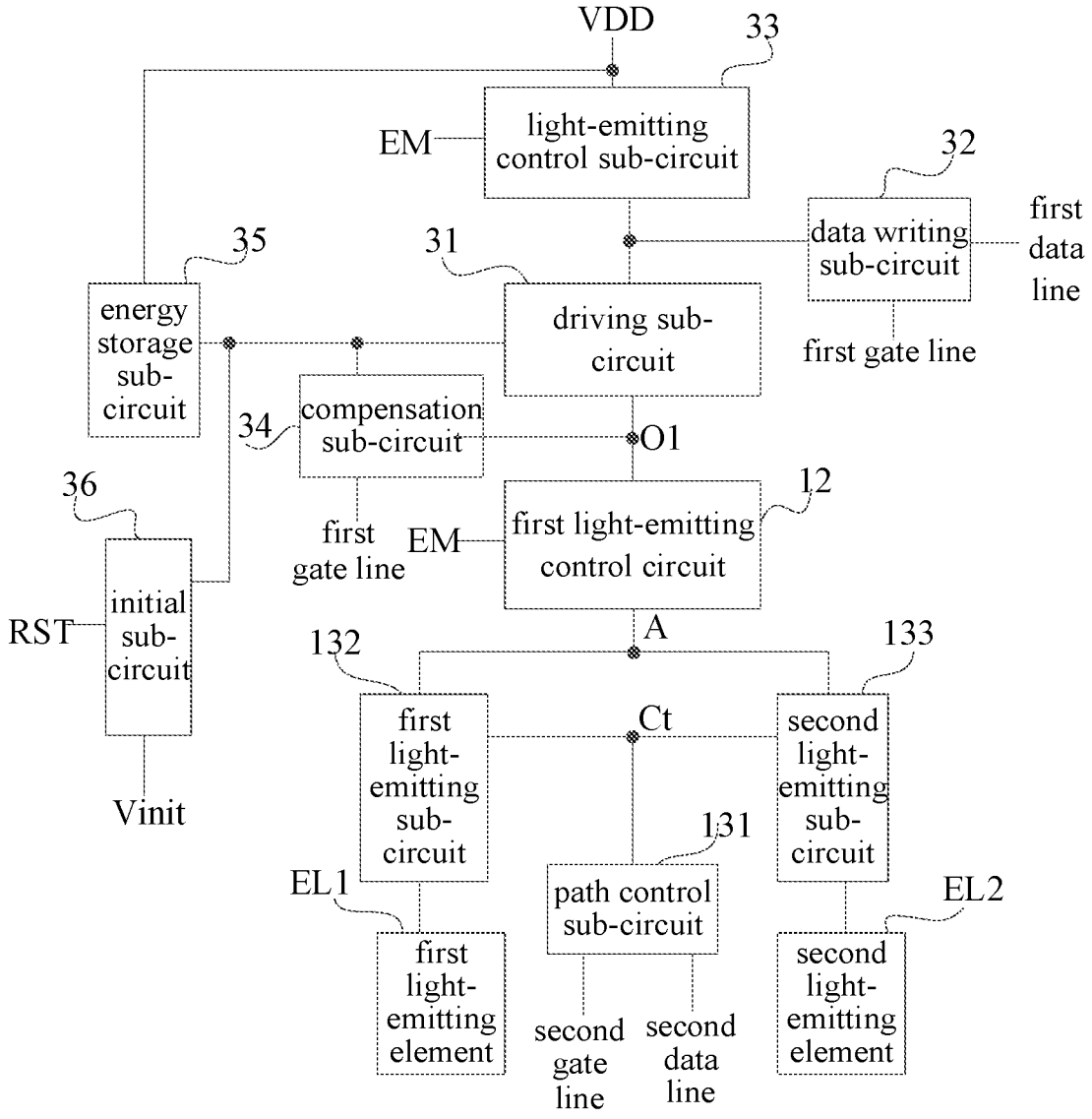
FIG. 3 is a structure diagram of a pixel circuit according to an embodiment of the present disclosure.

As shown in FIG. 3, on the basis of the embodiment of the pixel circuit shown in FIG. 1, the driving circuit may further include a driving sub-circuit 31, a data writing sub-circuit 32, a light-emitting control sub-circuit 33, a compensation sub-circuit 34, an energy storage sub-circuit 35 and an initial sub-circuit 36;

the data writing sub-circuit 32 is electrically connected to the first gate line Gate_A, the first data line Data_I and the first terminal of the driving sub-circuit 11, and configured for controlling to write the first data voltage provided by the first data line Data_I into the first terminal of the driving sub-circuit 31 under the control of the first gate driving signal provided by the first gate line Gate_A;

the light-emitting control sub-circuit 33 is electrically connected to the first light-emitting control line EM, the supply-voltage terminal and the first terminal of the driving sub-circuit 31, and configured for electrically connecting the supply-voltage terminal to the first terminal of the driving sub-circuit or electrically disconnecting the supply-voltage terminal from the first terminal of the driving sub-circuit 31 under the control of the first light-emitting control signal provided by the first light-emitting control line EM; the supply-voltage terminal is configured for providing a power voltage VDD;

the first terminal of the energy storage sub-circuit 35 is electrically connected to the control terminal of the driving sub-circuit 31, and the second terminal of the energy storage sub-circuit 35 is electrically connected to the supply-voltage terminal;

the second terminal of the driving sub-circuit 31 is electrically connected to the driving current output terminal O1, and the driving sub-circuit 31 is configured for electrically connecting the first terminal of the driving sub-circuit 31 to the driving current output terminal O1 or electrically disconnecting the first terminal of the driving sub-circuit 31 from the driving current output terminal O1 under the control of the potential of the control terminal thereof;

the compensation sub-circuit 34 is electrically connected to the first gate line Gate_A, a control terminal of the driving sub-circuit 31 and a second terminal of the driving sub-circuit 31, and configured for electrically connecting the control terminal of the driving sub-circuit 31 to the second terminal of the driving sub-circuit 31 or electrically disconnecting the control terminal of the driving sub-circuit 31 from the second terminal of the driving sub-circuit 31 under the control of the first gate driving signal; and the initial sub-circuit 36 is electrically connected to the reset terminal RST, a control terminal of the driving sub-circuit 31 and the initialization voltage terminal, and configured for writing the initialization voltage Vint provided by the initialization voltage terminal into the control terminal of the driving sub-circuit 31 under the control of the reset control signal provided by the reset terminal RST.

In actual implementation, the structure of the driving circuit is not limited to the structure in FIG. 3, and the circuit structure of the driving circuit capable of providing the driving current according to the first data voltage can all be applied to the pixel circuit described in embodiment of the present disclosure.

In particular implementation, the first light-emitting control circuit may include a first light-emitting control transistor, the light-emitting control sub-circuit may include a second light-emitting control transistor, the driving sub-circuit may include a driving transistor, the data writing sub-circuit may include a data writing transistor, and the compensation sub-circuit may include a compensating transistor; the energy storage sub-circuit may include a storage capacitor;

the control electrode of the first light-emitting control transistor is electrically connected to the first light-emitting control line, the first electrode of the first light-emitting control transistor is electrically connected to the driving current output terminal, and the second electrode of the first light-emitting control transistor is electrically connected to the writing node;

the control electrode of the second light-emitting control transistor is electrically connected to the first light-emitting control line, the first electrode of the first light-emitting control transistor is electrically connected to the supply-voltage terminal, and the second electrode of the first light-emitting control transistor is electrically connected to the first electrode of the driving transistor;

the control electrode of the data writing transistor is electrically connected to the first gate line, the first electrode of the data writing transistor is electrically connected to the first data line, and the second electrode of the data writing transistor is electrically connected to the first electrode of the driving transistor;

the control electrode of the compensating transistor is electrically connected to the first gate line, the first electrode of the compensating transistor is electrically connected to the control electrode of the driving transistor, and the second electrode of the compensating transistor is electrically connected to the second electrode of the driving transistor;

the second electrode of the driving transistor is electrically connected to the driving current output terminal; and the first terminal of the storage capacitor is electrically connected to the control electrode of the driving transistor, and the second terminal of the storage capacitor is electrically connected to the supply-voltage terminal.

Optionally, the initial sub-circuit may include an initial transistor; the control electrode of the initial transistor is electrically connected to the reset terminal, the first electrode of the initial transistor is electrically connected to the initialization voltage terminal, and the second electrode of the initial transistor is electrically connected to the control terminal of the driving sub-circuit.

The pixel circuit of the present disclosure will be described below through a particular embodiment.

Figure 4:
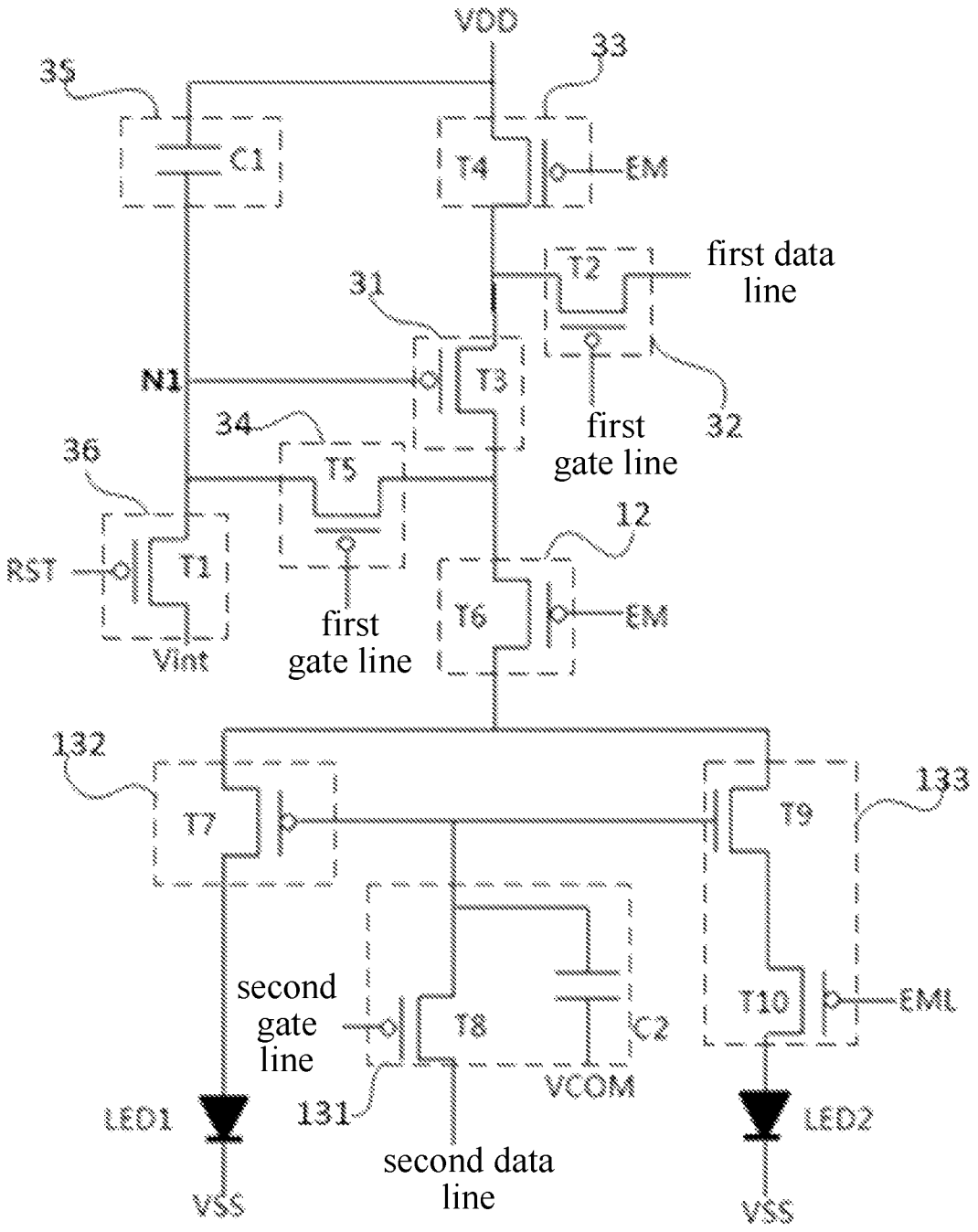
FIG. 4 is a circuit diagram of an implementation of the pixel circuit of the present disclosure.

As shown in FIG. 4, a particular embodiment of the pixel circuit of the present disclosure includes a driving circuit 11, a first light-emitting control circuit 12, and a light-emitting circuit, wherein the light-emitting circuit includes a path control sub-circuit 131, a first light-emitting sub-circuit 132, a first mini light emitting diode LED1, a second light-emitting sub-circuit 133 and a second mini light emitting diode LED2;

the path control sub-circuit 131 includes a path controlling transistor T8 and a maintaining capacitor C2;

the gate electrode of the path controlling transistor T8 is electrically connected to a second gate line Gate_B, the source electrode of the path controlling transistor T8 is electrically connected to the control terminal Ct, and the drain electrode of the path controlling transistor T8 is electrically connected to the second data line Data_T;

the first terminal of the maintaining capacitor C2 is electrically connected to the control terminal Ct, and the second terminal of the maintaining capacitor C2 is electrically connected to a reference voltage input terminal; the reference voltage input terminal is configured for providing a reference voltage VCOM;

the first light-emitting sub-circuit 132 may include a first display control transistor T7;

the gate electrode of the first display control transistor T7 is electrically connected to the control terminal Ct, the source electrode of the first display control transistor T7 is electrically connected to the writing node A, and the drain electrode of the first display control transistor T7 is electrically connected to the anode of the first mini light emitting diode LED1;

a low voltage VSS is inputted into the cathode of a first mini light emitting diode LED1;

the second light-emitting sub-circuit 133 includes a second display control transistor T9 and a third display control transistor T10, wherein the gate electrode of the second display control transistor T9 is electrically connected to the control terminal Ct, and the drain electrode of the second display control transistor T9 is electrically connected to the writing node A;

the gate electrode of the third display control transistor T10 is electrically connected to the second light-emitting control line (EML), the source electrode of the third display control transistor T10 is electrically connected to the source electrode of the second display control transistor T9, and the drain electrode of the third display control transistor T10 is electrically connected to the anode of the second mini light emitting diode LED2; and the low voltage VSS is inputted into the cathode of the second mini light emitting diode LED2.

The driving circuit includes a driving sub-circuit 31, a data writing sub-circuit 32, a light-emitting control sub-circuit 33, a compensation sub-circuit 34, an energy storage sub-circuit 35 and an initial sub-circuit 36;

the first light-emitting control circuit 12 includes a first light-emitting control transistor T6, the light-emitting control sub-circuit 33 includes a second light-emitting control transistor T4, the driving sub-circuit 31 includes a driving transistor T3, the data writing sub-circuit 32 includes a data writing transistor T2, and the compensation sub-circuit 34 includes a compensating transistor T5; the energy storage sub-circuit 35 includes a storage capacitor C1; the initial sub-circuit 36 includes an initial transistor T1;

the gate electrode of the first light-emitting control transistor T6 is electrically connected to the first light-emitting control line EM, the source electrode of the first light-emitting control transistor T6 is electrically connected to the driving current output terminal O1, and the drain electrode of the first light-emitting control transistor T6 is electrically connected to the writing node A;

the gate electrode of the second light-emitting control transistor T4 is electrically connected to the first light-emitting control line EM, the source electrode of the first light-emitting control transistor T4 is electrically connected to the supply-voltage terminal, and the drain electrode of the first light-emitting control transistor T4 is electrically connected to the source electrode of the driving transistor T3; the supply-voltage terminal is configured for providing a power voltage VDD;

the gate electrode of the data writing transistor T2 is electrically connected to the first gate line Gate_A, the source electrode of the data writing transistor T2 is electrically connected to the first data line Data_I, and the drain electrode of the data writing transistor T2 is electrically connected to the source electrode of the driving transistor T3;

the gate electrode of the compensating transistor T5 is electrically connected to the first gate line Gate_A, the source electrode of the compensating transistor T5 is electrically connected to the gate electrode of the driving transistor T3, and the drain electrode of the compensating transistor T5 is electrically connected to the drain electrode of the driving transistor T3;

the drain electrode of the driving transistor T3 is electrically connected to the driving current output terminal O1;

the first terminal of the storage capacitor C1 is electrically connected to the gate electrode of the driving transistor T3, and the second terminal of the storage capacitor C1 is electrically connected to the supply-voltage terminal; and the gate electrode of the initial transistor T1 is electrically connected to the reset terminal RST, the source electrode of the initial transistor T1 is electrically connected to the initialization voltage terminal, and the drain electrode of the initial transistor T1 is electrically connected to the gate electrode of the driving transistor T3.

In the particular embodiment of the pixel circuit shown in FIG. 4, the first node N1 is electrically connected to the gate electrode of T3.

In the particular embodiment of the pixel circuit shown in FIG. 4, T9 is an NMOS transistor and the other transistors are PMOS transistors, but the present disclosure is not limited thereto.

Figure 5:
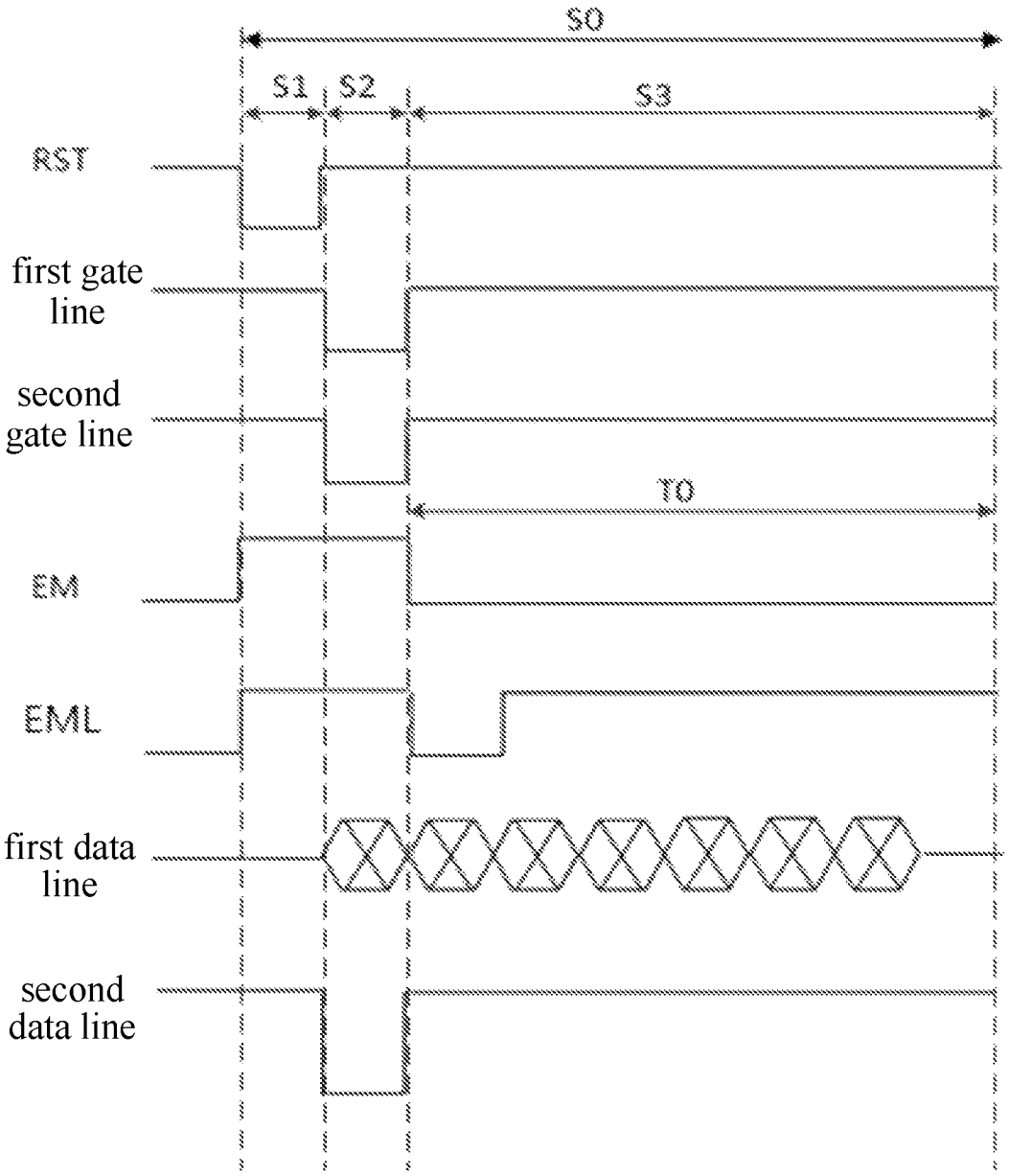
FIG. 5 is a timing diagram of the pixel circuit of FIG. 4 in a high grayscale display mode during operation.
Figure 6:
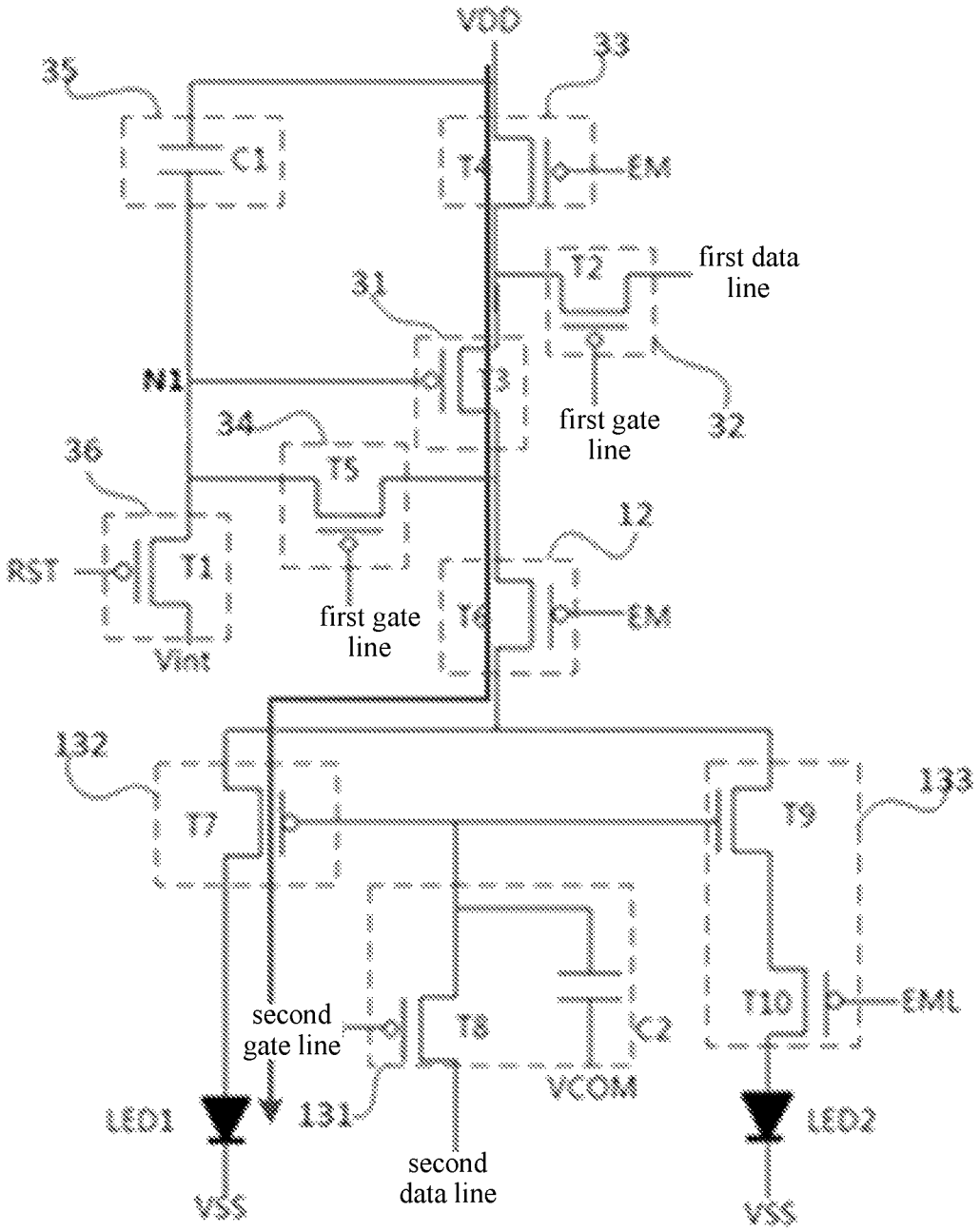
FIG. 6 is a schematic diagram of path 1.

During the operation of the pixel circuit shown in FIG. 4 in the embodiment of the present disclosure, in a high grayscale display mode, as shown in FIG. 5, the display period S0 may include a reset stage S1, a data writing stage S2 and a light-emitting stage S3 which are arranged in sequence;

in the reset stage S1, the RST provides a low voltage, the Gate_A provides a high voltage, the Gate_B provides a high voltage, the EM provides a high voltage, the EML provides a high voltage, and the T1 is turned on so as to provide the the Vinit to the first node N1;

in the data writing stage S2, the RST provides the high voltage, the Gate_A provides the low voltage, the Gate_B provides the low voltage, the EM provides the high voltage, the EML provides the high voltage, the Data_I provides the first data voltage Vdata1, the Data_T provides the low voltage, the T1 is turned off, the T2, T5 and T8 are turned on so as to write a first data voltage into the source electrode of the T3, and to write the low voltage into the control terminal Ct; at the beginning of the data writing stage, the T3 is turned on until the potential of the N1 becomes Vdata1+Vth, and then the T3 is turned off, wherein the Vth is a threshold voltage of the T3 for the threshold voltage compensation; and in the light-emitting stage S3, the RST provides a high voltage, the Gate_A provides a high voltage, the Gate_B provides a high voltage, the EM provides a low voltage, the C2 maintains the potential of the control terminal Ct, the T4 is turned on, the T3 is turned on, the T6 is turned on, the T7 is turned on, and the path 1 is on so as to achieve the high grayscale display; as shown in FIG. 6, the path 1 sequentially passes through the supply-voltage terminal, the T4, the T3, the T6, the T7 and the LED 1.

As shown in FIG. 5, the TO is the first light-emitting time of the LED1. During the operation of the pixel circuit shown in FIG. 4 of the embodiment of the present disclosure, when the path 1 is turned on, the long duration TO is used, and the value of the first data voltage Vdata1 provided by the Data_I is within the range of the high current density, and thus the two cooperate to enable 50-255 grayscale brightness.

In the embodiment of the present disclosure, the display period may be the time for displaying an image frame, but the present disclosure is not limited to.

Figure 7:
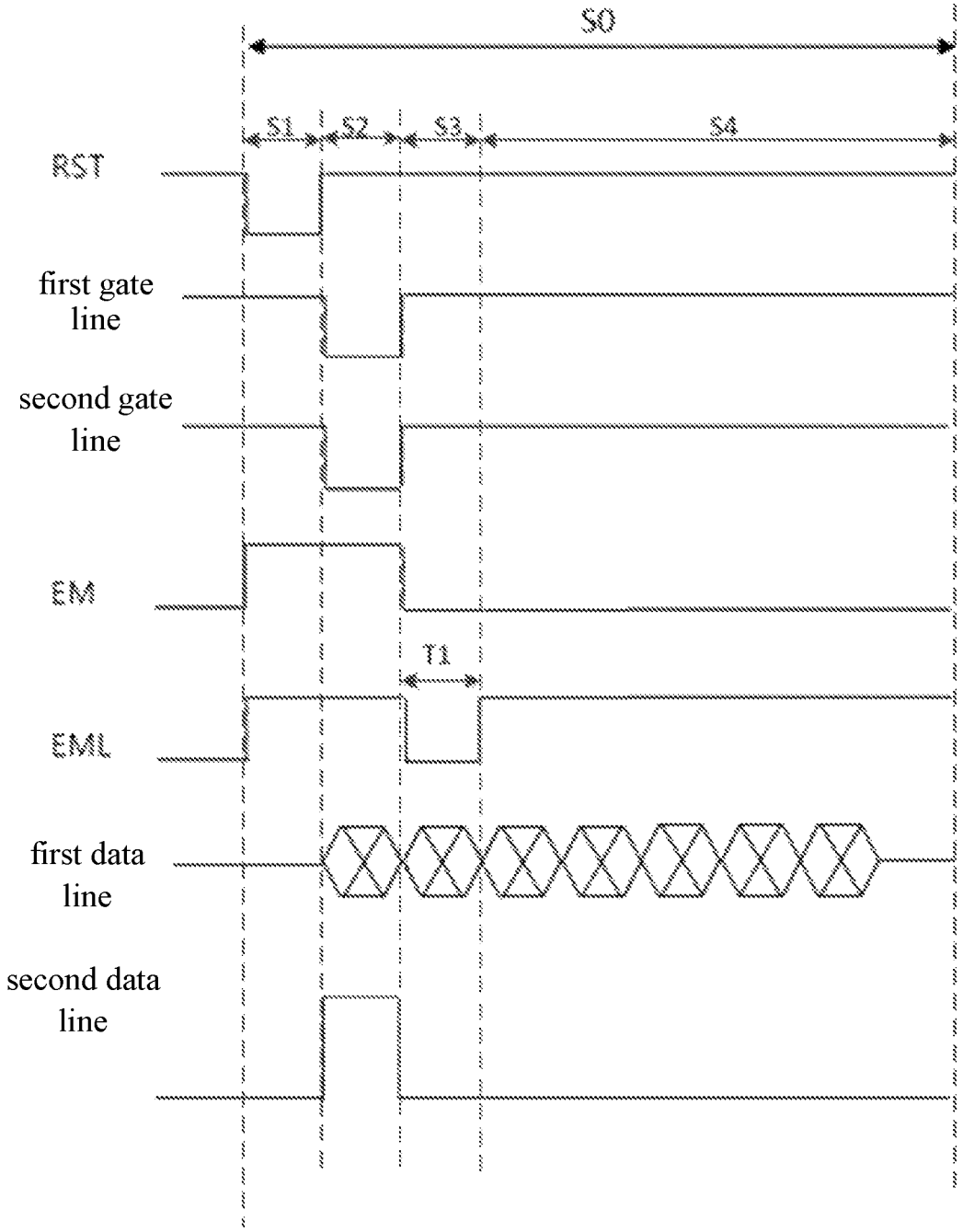
FIG. 7 is a timing diagram of the pixel circuit of FIG. 4 in a low grayscale display mode during operation.
Figure 8:
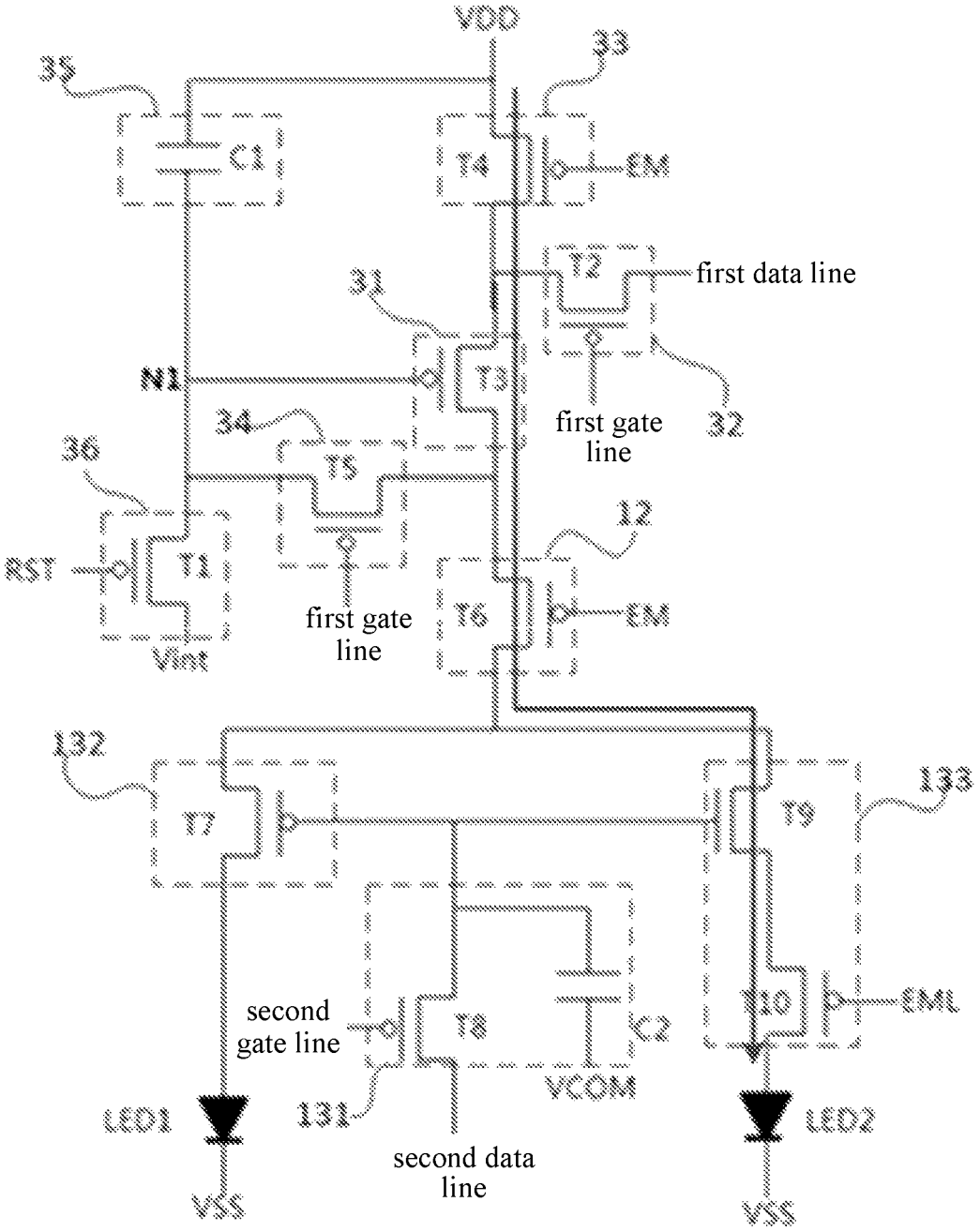
FIG. 8 is a schematic diagram of path 2.

During the operation of the pixel circuit shown in FIG. 4, in the low grayscale display mode, as shown in FIG. 7, the display period S0 may include a reset stage S1, a data writing stage S2, a light-emitting stage S3 and a light-extinguishing stage S4 which are arranged in sequence;

during the reset stage S1, RST provides a low voltage, Gate_A provides a high voltage, Gate_B provides a high voltage, EM provides a high voltage, EML provides a high voltage, and T1 is turned on so as to provide Vinit to a first node N1;

during the data writing stage S2, RST provides a high voltage, Gate_A provides a low voltage, Gate_B provides a low voltage, EM provides a high voltage, EML provides a high voltage, Data_I provides a first data voltage Vdata1, Data_T provides a high voltage, T1 is turned off, T2, T5 and T8 are turned on so as to write a first data voltage into a source electrode of T3, and to write a low voltage into a control terminal Ct; at the beginning of the data writing stage, T3 is turned on until the potential of N1 becomes Vdata1+Vth, and then T3 is turned off, wherein Vth is a threshold voltage of T3 for threshold voltage compensation;

during the light-emitting stage S3, the RST provides a high voltage, the Gate_A provides a high voltage, the Gate_B provides a high voltage, the EM provides a low voltage, the EML provides a low voltage, the C2 maintains the potential of the control terminal Ct, the T4 is turned on, the T3 is turned on, the T6 is turned on, the T9 is turned on, the T10 is turned on, and the path 2 is turned on so as to achieve a low grayscale display; as shown in FIG. 8, the path 2 sequentially passes through a supply-voltage terminal, T4, T3, T6, T9, T10 and an LED2; and during the light-extinguishing stage S4, RST provides a high voltage, Gate_A provides a high voltage, Gate_B provides a high voltage, EM provides a low voltage, EML provides a high voltage, T10 is turned off, and the LED2 stops emitting light.

The second light-emitting time, labeled T1 in FIG. 7, is less than TO.

During the operation of the pixel circuit shown in FIG. 4 of the embodiment of the present disclosure, when the path 2 is turned on, the short duration T1 is used, the value of the first data voltage Vdata1 provided by Data_I is within the range of the high current density, and thus the two cooperate to enable 0-50 grayscale brightness.

During the operation of the pixel circuit shown in FIG. 4 of the embodiment of the present disclosure, the LED1 or the LED2 may also be used to emit light.

Figure 9:
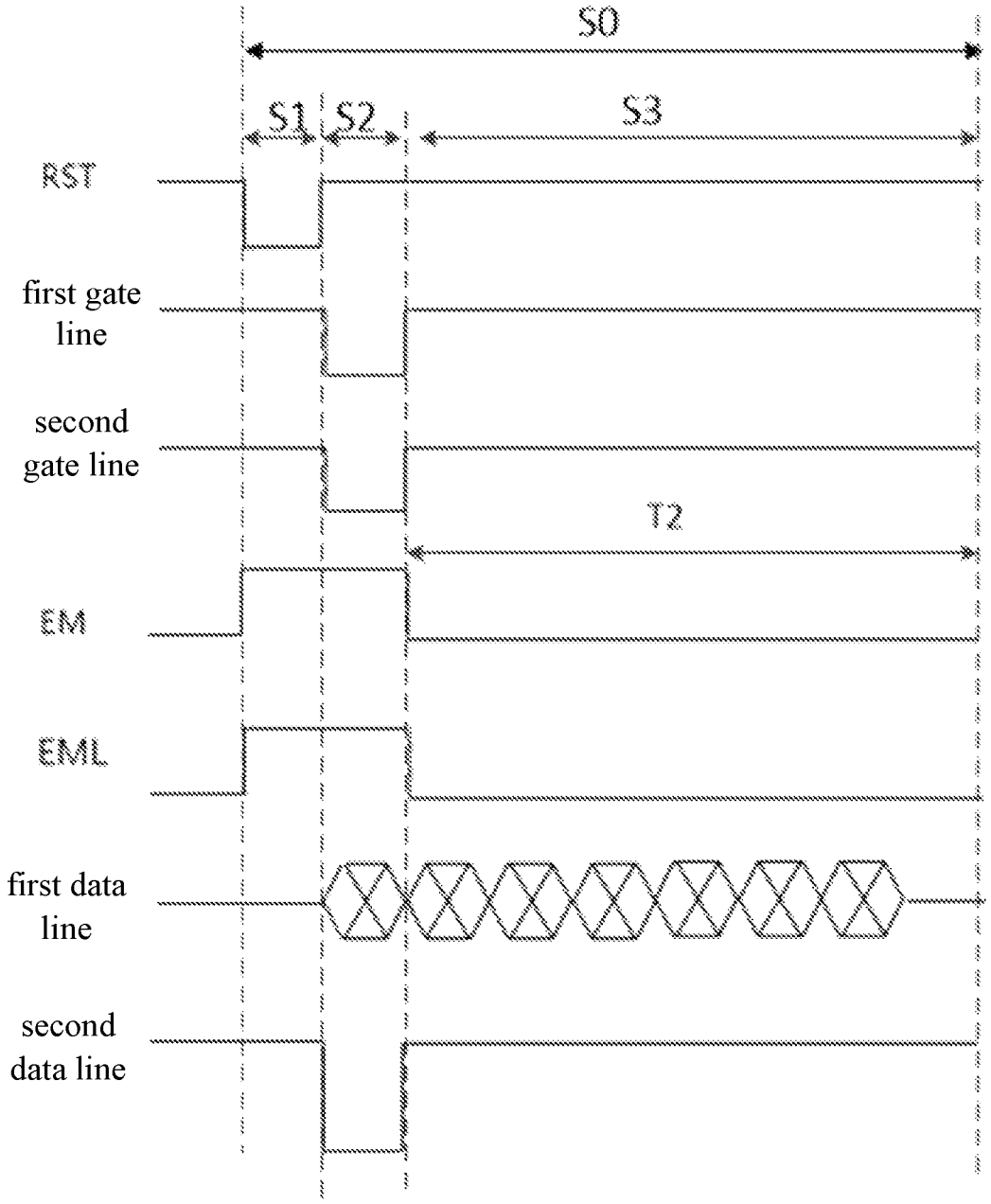
FIG. 9 is a timing diagram of the pixel circuit of FIG. 4 during operation when LED1 is used for emitting light.

As shown in FIG. 9, during the operation of the pixel circuit shown in FIG. 4 of the embodiment of the present disclosure, and when the LED1 is used to emit light, the display period may include a reset stage S1, a data writing stage S2 and a light-emitting stage S3 which are arranged in sequence;

during the reset stage S1, RST provides a low voltage, Gate_A provides a high voltage, Gate_B provides a high voltage, EM provides a high voltage, EML provides a high voltage, and T1 is turned on so as to provide Vinit to a first node N1;

during the data writing stage S2, RST provides a high voltage, Gate_A provides a low voltage, Gate_B provides a low voltage, EM provides a high voltage, EML provides a high voltage, Data_I provides a first data voltage Vdata1, Data_T provides a low voltage, T1 is turned off, T2, T5 and T8 are turned on so as to write a first data voltage into a source electrode of T3, and to write a low voltage into a control terminal Ct; at the beginning of a data writing stage, T3 is turned on until the potential of N1 becomes Vdata1+Vth, and then T3 is turned off, wherein Vth is a threshold voltage of T3 for threshold voltage compensation; and during the light-emitting stage S3, the RST provides a high voltage, the Gate_A provides a high voltage, the Gate_B provides a high voltage, the EM provides a low voltage, the EML provides a low voltage, the C2 maintains the potential of the control terminal Ct, the T4 is turned on, the T3 is turned on, the T6 is turned on, the T7 is turned on, and the path 1 is turned on so as to use the LED 1 to function; the path 1 sequentially passes through a supply-voltage terminal, T4, T3, T6, T7 and LED1.

In FIG. 9, the third light-emitting time for LED1 is labeled as T2.

When the particular embodiment of the pixel circuit shown in FIG. 4 of the present disclosure uses the LED1 to emit light, the third light-emitting time T2 of the LED1 can be fixed, and the high grayscale display and the low grayscale display of the LED1 are controlled by controlling the value of the first data voltage Vdata1. When the LED2 cannot emit light properly, the embodiment of the present disclosure can achieve the high grayscale display and the low grayscale display through the LED1.

Figure 10:
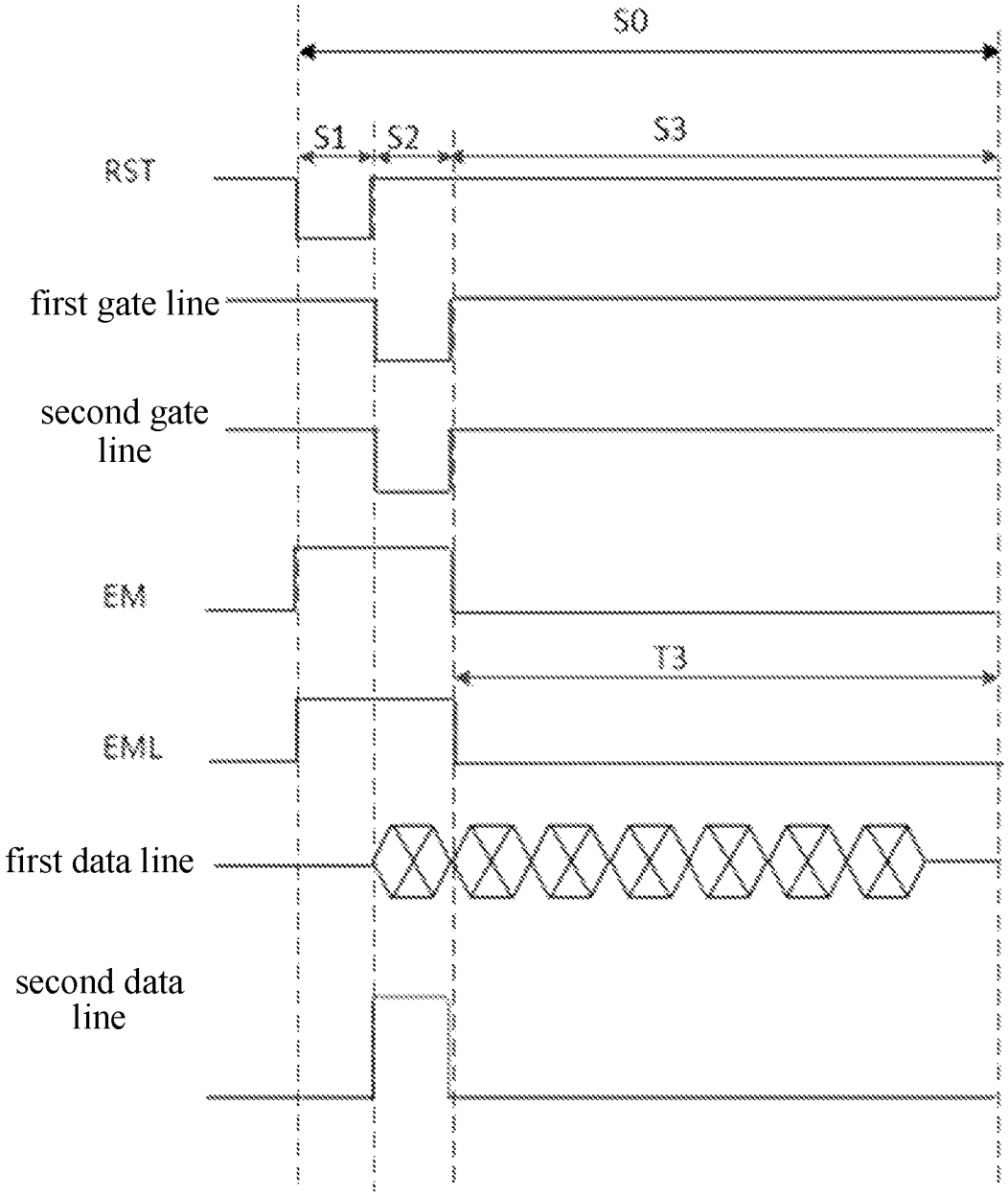
FIG. 10 is a timing diagram of the pixel circuit of FIG. 4 during operation when LED2 is used for emitting light.

As shown in FIG. 10, during the operation of the pixel circuit shown in FIG. 4 of the embodiment of the present disclosure, when the LED2 is used to emit light, a display period S0 may include a reset stage S1, a data writing stage S2 and a light-emitting stage S3 which are arranged in sequence;

during the reset stage S1, RST provides a low voltage, Gate_A provides a high voltage, Gate_B provides a high voltage, EM provides a high voltage, EML provides a high voltage, and T1 is turned on so as to provide Vinit to a first node N1;

during the data writing stage S2, RST provides a high voltage, Gate_A provides a low voltage, Gate_B provides a low voltage, EM provides a high voltage, EML provides a high voltage, Data_I provides a first data voltage Vdata1, Data_T provides a high voltage, T1 is turned off, T2, T5 and T8 are turned on so as to write a first data voltage into a source electrode of T3, and to write a low voltage into a control terminal Ct; at the beginning of the data writing stage, T3 is turned on until the potential of N1 becomes Vdata1+Vth, and then T3 is turned off, wherein Vth is a threshold voltage of T3 for threshold voltage compensation; and during the light-emitting stage S3, the RST provides a high voltage, the Gate_A provides a high voltage, the Gate_B provides a high voltage, the EM provides a low voltage, the EML provides a low voltage, the C2 maintains the potential of the control terminal Ct, the T4 is turned on, the T3 is turned on, the T6 is turned on, the T9 is turned on, the T10 is turned on, and the path 2 is turned on so as to realize a low grayscale display; the path 2 sequentially passes through a supply-voltage terminal, a T4, T3, T6, T9, T10 and LED2.

In FIG. 10, the fourth light-emitting time for LED2 is labeled as T3.

When the particular embodiment of the pixel circuit shown in FIG. 4 of the present disclosure uses the LED2 to emit light, the fourth light-emitting time T3 of the LED2 can be fixed, and the high grayscale display and the low grayscale display of the LED2 are controlled by controlling the value of the first data voltage Vdata1. When the LED1 cannot emit light properly, the embodiment of the present disclosure can implement the high grayscale display and the low grayscale display through the LED2.

The pixel driving method described in the embodiment of the present disclosure is applied to the above-mentioned pixel circuit, and the pixel driving method includes:

a driving circuit generating, under control of a first gate driving signal provided by the first gate line, a driving current according to a first data voltage on the first data line;

a first light-emitting control circuit controlling, under the control of the first light-emitting control signal provided by the first light-emitting control line, to electrically connect the driving current output terminal to the writing node or electrically disconnect the driving current output terminal from the writing node;

a path control sub-circuit writing a second data voltage on a second data line into a control terminal under the control of a second gate driving signal provided by a second gate line, and maintaining the potential of the control terminal;

a first light-emitting sub-circuit electrically connecting the writing node to the first light-emitting element or electrically disconnecting the writing node from the first light-emitting element under the control of the potential of the control terminal; and a second light-emitting sub-circuit electrically connecting the writing node to the second light-emitting element or electrically disconnecting the writing node from the second light-emitting element under the control of the potential of the control terminal and a second light-emitting control signal provided by the second light-emitting control line.

In the pixel driving method according to the embodiment of the present disclosure can implement the driving of the high grayscale voltage and the driving of the low grayscale voltage independently through the current control and the time duration control, satisfying both long duration driving with respect to the high grayscale and high current driving with respect to the low grayscale; furthermore, the pixel driving method described in the embodiment of the present disclosure may enable that, when one of the light-emitting elements cannot emit light properly, the other light-emitting element can still emit light properly to implement the high and low grayscales, thereby reducing the dark point defect and improving the backplate yield.

According to a particular embodiment, a display period includes a data writing stage and a light-emitting stage which are arranged sequentially; the pixel driving method specifically includes: under high grayscale display mode, during the data writing stage, the driving circuit receiving the first data voltage under the control of the first gate driving signal; the path control sub-circuit writing the second data voltage into the control terminal under the control of the second gate driving signal; the first light-emitting control circuit disconnecting the driving current output terminal from the writing node under the control of the first light-emitting control signal; and during the light-emitting stage, the driving circuit generating the driving current according to the first data voltage, and the first light-emitting control circuit electrically connecting the driving current output terminal to the writing node under the control of the first light-emitting control signal; the path control sub-circuit maintaining the potential of the control terminal, the first light-emitting sub-circuit electrically connecting the writing node to the first light-emitting element under the control of the potential of the control terminal, and the driving circuit driving the first light-emitting element to emit light; the second light-emitting sub-circuit disconnecting the writing node from the second light-emitting element under the control of the potential of the control terminal and the second light-emitting control signal.

In the pixel driving method described in embodiment of the present disclosure, the individual driving of the high grayscale voltage can be implemented by the current control and the duration control to satisfy the long duration driving of the high grayscale.

According to another particular embodiment, the display period includes a data writing stage and a light-emitting stage which are arranged in sequence; the pixel driving method specifically includes: under low grayscale display mode, during the data writing stage, the driving circuit receiving the first data voltage under the control of the first gate driving signal; the path control sub-circuit writing the second data voltage into the control terminal under the control of the second gate driving signal; the first light-emitting control circuit disconnecting the driving current output terminal from the writing node under the control of the first light-emitting control signal; and during the light-emitting stage, the driving circuit generating the driving current according to the first data voltage, and the first light-emitting control circuit electrically connecting the driving current output terminal to the writing node under the control of the first light-emitting control signal; the path control sub-circuit maintaining the potential of the control terminal, the first light-emitting sub-circuit disconnecting the writing node from the first light-emitting element under the control of the potential of the control terminal, and the driving circuit drives the first light-emitting element to emit light; the second light-emitting sub-circuit electrically connecting the writing node to the second light-emitting element under the control of the potential of the control terminal and the second light-emitting control signal, and the driving circuit driving the second light-emitting element to emit light.

In the pixel driving method according to the embodiment of the present disclosure, the individual driving of the low grayscale voltage can be implemented by the current control and the duration control to satisfy the low grayscale display with the high driving current.

In a particular embodiment, the display period further includes a light-extinguishing stage arranged after the light-emitting stage;

during the light-extinguishing stage, the second light-emitting control circuit disconnecting the writing node from the second light-emitting element under the control of the potential of the control terminal and the second light-emitting control signal, and the second light-emitting element stopping emitting light.

According to a particular embodiment, a display period includes a data writing stage and a light-emitting stage which are arranged in sequence; the pixel driving method includes: when the first light-emitting element is used for emitting light, during the data writing stage, the driving circuit receiving the first data voltage under the control of the first gate driving signal; the path control sub-circuit writing the second data voltage into the control terminal under the control of the second gate driving signal; the first light-emitting control circuit disconnecting the driving current output terminal from the writing node under the control of the first light-emitting control signal; and during the light-emitting stage, the driving circuit generating the driving current according to the first data voltage, and the first light-emitting control circuit electrically connecting the driving current output terminal to the writing node under the control of the first light-emitting control signal; the path control sub-circuit maintaining the potential of the control terminal, the first light-emitting sub-circuit electrically connecting the writing node to the first light-emitting element under the control of the potential of the control terminal, and the driving circuit driving the first light-emitting element to emit light; the second light-emitting sub-circuit disconnecting the writing node from the second light-emitting element under the control of the potential of the control terminal and the second light-emitting control signal.

In the pixel driving method according to the embodiment of the present disclosure, the first light-emitting element is used to emit light, and the high grayscale display and the low grayscale display can be achieved by adjusting the first data voltage to adjust the driving current when the light-emitting duration is fixed.

According to a particular embodiment, a display period includes a data writing stage and a light-emitting stage which are arranged in sequence; the pixel driving method includes: when the second light-emitting element is used for emitting light, during the data writing stage, the driving circuit receiving the first data voltage under the control of the first gate driving signal; the path control sub-circuit writing the second data voltage into the control terminal under the control of the second gate driving signal; the first light-emitting control circuit disconnecting the driving current output terminal from the writing node under the control of the first light-emitting control signal; and during the light-emitting stage, the driving circuit generating the driving current according to the first data voltage, and the first light-emitting control circuit electrically connecting the driving current output terminal to the writing node under the control of the first light-emitting control signal; the path control sub-circuit maintaining the potential of the control terminal, and the first light-emitting sub-circuit disconnecting the writing node from the first light-emitting element under the control of the potential of the control terminal; the second light-emitting sub-circuit electrically connecting the writing node to the second light-emitting element under the control of the potential of the control terminal and the second light-emitting control signal, and the driving circuit driving the second light-emitting element to emit light.

In the pixel driving method described in embodiment of the present disclosure, a second light-emitting element can be used to emit light, and the high grayscale display and the low grayscale display can be realized by adjusting the first data voltage to adjust the driving current when the light-emitting duration is fixed.

The display device according to the embodiment of the present disclosure includes the pixel circuit described above.

The display device provided by the embodiment of the present disclosure may be any product or component having a display function, such as a cell phone, a tablet computer, a television, a display, a notebook computer, a digital photo frame, a navigator, etc.

The above relate to some embodiments of the present disclosure. It should be noted that for those skilled in the art, improvements and modifications can be made without departing from the principles described in the present disclosure, which should be regarded as falling within the protection scope of the present disclosure.

What is claimed is:

1. A pixel circuit, comprising: a driving circuit, a first light-emitting control circuit and a light-emitting circuit, wherein the driving circuit is electrically connected to a first data line and a first gate line, and configured for generating, under control of a first gate driving signal provided by the first gate line, a driving current according to a first data voltage on the first data line;

the first light-emitting control circuit is electrically connected to a first light-emitting control line, a driving current output terminal of the driving circuit and a writing node, and configured for controlling, under control of a first light-emitting control signal provided by the first light-emitting control line, to electrically connect the driving current output terminal to the writing node or electrically disconnect the driving current output terminal from the writing node;

the light-emitting circuit comprises a path control sub-circuit, a first light-emitting sub-circuit, a first light-emitting element, a second light-emitting sub-circuit and a second light-emitting element;

the path control sub-circuit is electrically connected to a second gate line, a second data line and a control terminal, and configured for controlling, under control of a second gate driving signal provided by the second gate line, to write a second data voltage on the second data line into the control terminal, and maintaining potential of the control terminal;

the first light-emitting sub-circuit is electrically connected to the control terminal, the writing node and the first light-emitting element, and configured for, under control of the potential of the control terminal, electrically connecting the writing node to the first light-emitting element or electrically disconnecting the writing node from the first light-emitting element;

the second light-emitting sub-circuit is electrically connected to the writing node, the second light-emitting element, the control terminal and a second light-emitting control line, and configured for, under the control of the potential of the control terminal and a second light-emitting control signal provided by the second light-emitting control line, electrically connecting the writing node to the second light-emitting element or electrically disconnecting the writing node from the second light-emitting element.

2. The pixel circuit according to claim 1, wherein the path control sub-circuit comprises a path controlling transistor and a maintaining capacitor;

a control electrode of the path controlling transistor is electrically connected to the second gate line, a first electrode of the path controlling transistor is electrically connected to the control terminal, and a second electrode of the path controlling transistor is electrically connected to the second data line;

a first terminal of the maintaining capacitor is electrically connected to the control terminal, and a second terminal of the maintaining capacitor is electrically connected to a reference voltage input terminal.

3. The pixel circuit according to claim 1, wherein the first light-emitting sub-circuit comprises a first display control transistor;

a control electrode of the first display control transistor is electrically connected to the control terminal, a first electrode of the first display control transistor is electrically connected to the writing node, and a second electrode of the first display control transistor is electrically connected to the first light-emitting element.

4. The pixel circuit according to claim 1, wherein the second light-emitting sub-circuit comprises a second display control transistor and a third display control transistor, wherein a control electrode of the second display control transistor is electrically connected to the control terminal, and a first electrode of the second display control transistor is electrically connected to the writing node;

the control electrode of the third display control transistor is electrically connected to the second light-emitting control line, a first electrode of the third display control transistor is electrically connected to a second electrode of the second display control transistor, and a second electrode of the third display control transistor is electrically connected to the second light-emitting element.

5. The pixel circuit according to claim 1, wherein the driving circuit comprises a driving sub-circuit, a data writing sub-circuit, a light-emitting control sub-circuit, a compensation sub-circuit and an energy storage sub-circuit;

the data writing sub-circuit is electrically connected to the first gate line, the first data line and a first terminal of the driving sub-circuit, and configured for controlling to write the first data voltage into the first terminal of the driving sub-circuit under the control of the first gate driving signal;

the light-emitting control sub-circuit is electrically connected to a first light-emitting control line, a supply-voltage terminal and the first terminal of the driving sub-circuit, and configured for, under control of the first light-emitting control signal, electrically connecting the supply-voltage terminal to the first terminal of the driving sub-circuit or electrically disconnecting the supply-voltage terminal from the first terminal of the driving sub-circuit;

a first terminal of the energy storage sub-circuit is electrically connected to a control terminal of the driving sub-circuit, and a second terminal of the energy storage sub-circuit is electrically connected to the supply-voltage terminal;

a second terminal of the driving sub-circuit is electrically connected to the driving current output terminal, and the driving sub-circuit is configured for, under the control of the potential of the control terminal of the driving sub-circuit, electrically connecting the first terminal of the driving sub-circuit to the driving current output terminal or electrically disconnecting the first terminal of the driving sub-circuit from the driving current output terminal;

the compensation sub-circuit is electrically connected to the first gate line, the control terminal of the driving sub-circuit and the second terminal of the driving sub-circuit, and configured for, under the control of the first gate driving signal, electrically connecting the control terminal of the driving sub-circuit to the second terminal of the driving sub-circuit or electrically disconnecting the control terminal of the driving sub-circuit from the second terminal of the driving sub-circuit.

6. The pixel circuit according to claim 2, wherein the driving circuit comprises a driving sub-circuit, a data writing sub-circuit, a light-emitting control sub-circuit, a compensation sub-circuit and an energy storage sub-circuit;

the data writing sub-circuit is electrically connected to the first gate line, the first data line and a first terminal of the driving sub-circuit, and configured for controlling to write the first data voltage into the first terminal of the driving sub-circuit under the control of the first gate driving signal;

the light-emitting control sub-circuit is electrically connected to a first light-emitting control line, a supply-voltage terminal and the first terminal of the driving sub-circuit, and configured for, under control of the first light-emitting control signal, electrically connecting the supply-voltage terminal to the first terminal of the driving sub-circuit or electrically disconnecting the supply-voltage terminal from the first terminal of the driving sub-circuit;

a first terminal of the energy storage sub-circuit is electrically connected to a control terminal of the driving sub-circuit, and a second terminal of the energy storage sub-circuit is electrically connected to the supply-voltage terminal;

a second terminal of the driving sub-circuit is electrically connected to the driving current output terminal, and the driving sub-circuit is configured for, under the control of the potential of the control terminal of the driving sub-circuit, electrically connecting the first terminal of the driving sub-circuit to the driving current output terminal or electrically disconnecting the first terminal of the driving sub-circuit from the driving current output terminal;

the compensation sub-circuit is electrically connected to the first gate line, the control terminal of the driving sub-circuit and the second terminal of the driving sub-circuit, and configured for, under the control of the first gate driving signal, electrically connecting the control terminal of the driving sub-circuit to the second terminal of the driving sub-circuit or electrically disconnecting the control terminal of the driving sub-circuit from the second terminal of the driving sub-circuit.

7. The pixel circuit according to claim 3, wherein the driving circuit comprises a driving sub-circuit, a data writing sub-circuit, a light-emitting control sub-circuit, a compensation sub-circuit and an energy storage sub-circuit;

the data writing sub-circuit is electrically connected to the first gate line, the first data line and a first terminal of the driving sub-circuit, and configured for controlling to write the first data voltage into the first terminal of the driving sub-circuit under the control of the first gate driving signal;

the light-emitting control sub-circuit is electrically connected to a first light-emitting control line, a supply-voltage terminal and the first terminal of the driving sub-circuit, and configured for, under control of the first light-emitting control signal, electrically connecting the supply-voltage terminal to the first terminal of the driving sub-circuit or electrically disconnecting the supply-voltage terminal from the first terminal of the driving sub-circuit;

a first terminal of the energy storage sub-circuit is electrically connected to a control terminal of the driving sub-circuit, and a second terminal of the energy storage sub-circuit is electrically connected to the supply-voltage terminal;

a second terminal of the driving sub-circuit is electrically connected to the driving current output terminal, and the driving sub-circuit is configured for, under the control of the potential of the control terminal of the driving sub-circuit, electrically connecting the first terminal of the driving sub-circuit to the driving current output terminal or electrically disconnecting the first terminal of the driving sub-circuit from the driving current output terminal;

the compensation sub-circuit is electrically connected to the first gate line, the control terminal of the driving sub-circuit and the second terminal of the driving sub-circuit, and configured for, under the control of the first gate driving signal, electrically connecting the control terminal of the driving sub-circuit to the second terminal of the driving sub-circuit or electrically disconnecting the control terminal of the driving sub-circuit from the second terminal of the driving sub-circuit.

8. The pixel circuit according to claim 4, wherein the driving circuit comprises a driving sub-circuit, a data writing sub-circuit, a light-emitting control sub-circuit, a compensation sub-circuit and an energy storage sub-circuit;

the data writing sub-circuit is electrically connected to the first gate line, the first data line and a first terminal of the driving sub-circuit, and configured for controlling to write the first data voltage into the first terminal of the driving sub-circuit under the control of the first gate driving signal;

the light-emitting control sub-circuit is electrically connected to a first light-emitting control line, a supply-voltage terminal and the first terminal of the driving sub-circuit, and configured for, under control of the first light-emitting control signal, electrically connecting the supply-voltage terminal to the first terminal of the driving sub-circuit or electrically disconnecting the supply-voltage terminal from the first terminal of the driving sub-circuit;

a first terminal of the energy storage sub-circuit is electrically connected to a control terminal of the driving sub-circuit, and a second terminal of the energy storage sub-circuit is electrically connected to the supply-voltage terminal;

a second terminal of the driving sub-circuit is electrically connected to the driving current output terminal, and the driving sub-circuit is configured for, under the control of the potential of the control terminal of the driving sub-circuit, electrically connecting the first terminal of the driving sub-circuit to the driving current output terminal or electrically disconnecting the first terminal of the driving sub-circuit from the driving current output terminal;

the compensation sub-circuit is electrically connected to the first gate line, the control terminal of the driving sub-circuit and the second terminal of the driving sub-circuit, and configured for, under the control of the first gate driving signal, electrically connecting the control terminal of the driving sub-circuit to the second terminal of the driving sub-circuit or electrically disconnecting the control terminal of the driving sub-circuit from the second terminal of the driving sub-circuit.

9. The pixel circuit according to claim 5, wherein the driving circuit further comprises an initial sub-circuit;

the initial sub-circuit is electrically connected to a reset terminal, the control terminal of the driving sub-circuit and an initialization voltage terminal, and configured for, under control of a reset control signal provided by the reset terminal, writing an initialization voltage provided by the initialization voltage terminal into the control terminal of the driving sub-circuit.

10. The pixel circuit according to claim 5, wherein the first light-emitting control circuit comprises a first light-emitting control transistor, the light-emitting control sub-circuit comprises a second light-emitting control transistor, the driving sub-circuit comprises a driving transistor, the data writing sub-circuit comprises a data writing transistor, the compensation sub-circuit comprises a compensating transistor, and the energy storage sub-circuit comprises a storage capacitor;

a control electrode of the first light-emitting control transistor is electrically connected to the first light-emitting control line, a first electrode of the first light-emitting control transistor is electrically connected to the driving current output terminal, and a second electrode of the first light-emitting control transistor is electrically connected to the writing node;

a control electrode of the second light-emitting control transistor is electrically connected to the first light-emitting control line, the first electrode of the first light-emitting control transistor is electrically connected to the supply-voltage terminal, and the second electrode of the first light-emitting control transistor is electrically connected to the first electrode of the driving transistor;

a control electrode of the data writing transistor is electrically connected to the first gate line, a first electrode of the data writing transistor is electrically connected to the first data line, and a second electrode of the data writing transistor is electrically connected to the first electrode of the driving transistor;

a control electrode of the compensating transistor is electrically connected to the first gate line, a first electrode of the compensating transistor is electrically connected to the control electrode of the driving transistor, and a second electrode of the compensating transistor is electrically connected to a second electrode of the driving transistor;

the second electrode of the driving transistor is electrically connected to the driving current output terminal;

a first terminal of the storage capacitor is electrically connected to the control electrode of the driving transistor, and a second terminal of the storage capacitor is electrically connected to the supply-voltage terminal.

11. The pixel circuit according to claim 9, wherein the initial sub-circuit comprises an initial transistor; a control electrode of the initial transistor is electrically connected to the reset terminal, a first electrode of the initial transistor is electrically connected to the initialization voltage terminal, and a second electrode of the initial transistor is electrically connected to the control terminal of the driving sub-circuit.

12. A pixel driving method, operably by the pixel circuit according to claim 1, comprising:

generating, by the driving circuit under the control of the first gate driving signal provided by the first gate line, the driving current according to the first data voltage on the first data line;

controlling, by the first light-emitting control circuit under the control of the first light-emitting control signal provided by the first light-emitting control line, to electrically connect the driving current output terminal to the writing node or electrically disconnect the driving current output terminal from the writing node;

writing, by the path control sub-circuit under the control of the second gate driving signal provided by the second gate line, the second data voltage on the second data line into the control terminal, and maintaining the potential of the control terminal;

electrically connecting, by the first light-emitting sub-circuit under the control of the potential of the control terminal, the writing node to the first light-emitting element, or electrically disconnecting, by the first light-emitting sub-circuit under the control of the potential of the control terminal, the writing node from the first light-emitting element;

electrically connecting, by the second light-emitting sub-circuit under the control of the potential of the control terminal and the second light-emitting control signal provided by the second light-emitting control line, the writing node to the second light-emitting element, or electrically disconnecting, by the second light-emitting sub-circuit under the control of the potential of the control terminal and the second light-emitting control signal provided by the second light-emitting control line, the writing node from the second light-emitting element.

13. The pixel driving method according to claim 12, wherein a display period comprises a data writing stage and a light-emitting stage that are arranged sequentially in that order;

the pixel driving method comprises: in a high grayscale display mode, during the data writing stage, the driving circuit receives a first data voltage under the control of the first gate driving signal, the path control sub-circuit writes the second data voltage into the control terminal under the control of the second gate driving signal, and the first light-emitting control circuit disconnects the driving current output terminal from the writing node under the control of the first light-emitting control signal;

during the light-emitting stage, the driving circuit generates the driving current according to the first data voltage, the first light-emitting control circuit electrically connects the driving current output terminal to the writing node under the control of the first light-emitting control signal, the path control sub-circuit maintains the potential of the control terminal, the first light-emitting sub-circuit electrically connects the writing node to the first light-emitting element under the control of the potential of the control terminal, the driving circuit drives the first light-emitting element to emit light, and the second light-emitting sub-circuit disconnects the writing node from the second light-emitting element under the control of the potential of the control terminal and the second light-emitting control signal;

the pixel driving method further comprises: in a low grayscale display mode, during the data writing stage, the driving circuit receives the first data voltage under the control of the first gate driving signal, the path control sub-circuit writes the second data voltage into the control terminal under the control of the second gate driving signal, and the first light-emitting control circuit disconnects the driving current output terminal from the writing node under the control of the first light-emitting control signal;

during the light-emitting stage, the driving circuit generates the driving current according to the first data voltage, the first light-emitting control circuit electrically connects the driving current output terminal to the writing node under the control of the first light-emitting control signal, the path control sub-circuit maintains the potential of the control terminal, the first light-emitting sub-circuit disconnects the writing node from the first light-emitting element under the control of the potential of the control terminal, the second light-emitting sub-circuit electrically connects the writing node to the second light-emitting element under the control of the potential of the control terminal and the second light-emitting control signal, and the driving circuit drives the second light-emitting element to emit light.

14. The pixel driving method according to claim 13, wherein the display period further comprises a light-extinguishing stage arranged after the light-emitting stage; and during the light-extinguishing stage, the second light-emitting control circuit disconnects the writing node from the second light-emitting element under the control of the potential of the control terminal and the second light-emitting control signal, and the second light-emitting element stops emitting light.

15. The pixel driving method according to claim 12, wherein the display period comprises a data writing stage and a light-emitting stage that are arranged sequentially in that order;

the pixel driving method comprises: when the first light-emitting element is used for emitting light, during the data writing stage, the driving circuit receives the first data voltage under the control of the first gate driving signal, the path control sub-circuit writes the second data voltage into the control terminal under the control of the second gate driving signal, and the first light-emitting control circuit disconnects the driving current output terminal from the writing node under the control of the first light-emitting control signal;

during the light-emitting stage, the driving circuit generates the driving current according to the first data voltage, the first light-emitting control circuit electrically connects the driving current output terminal to the writing node under the control of the first light-emitting control signal, the path control sub-circuit maintains the potential of the control terminal, the first light-emitting sub-circuit electrically connects the writing node to the first light-emitting element under the control of the potential of the control terminal, the driving circuit drives the first light-emitting element to emit light, and the second light-emitting sub-circuit disconnects the writing node from the second light-emitting element under the control of the potential of the control terminal and the second light-emitting control signal;

the pixel driving method further comprises: when the second light-emitting element is used for emitting light, during the data writing stage, the driving circuit receives the first data voltage under the control of the first gate driving signal, the path control sub-circuit writes the second data voltage into the control terminal under the control of the second gate driving signal, and the first light-emitting control circuit disconnects the driving current output terminal from the writing node under the control of the first light-emitting control signal;

during the light-emitting stage, the driving circuit generates the driving current according to the first data voltage, the first light-emitting control circuit electrically connects the driving current output terminal to the writing node under the control of the first light-emitting control signal, the path control sub-circuit maintains the potential of the control terminal, the first light-emitting sub-circuit disconnects the writing node from the first light-emitting element under the control of the potential of the control terminal, the second light-emitting sub-circuit electrically connects the writing node to the second light-emitting element under the control of the potential of the control terminal and the second light-emitting control signal, and the driving circuit drives the second light-emitting element to emit light.

16. A display device, comprising the pixel circuit according to claim 1.

17. The display device according to claim 16, wherein the path control sub-circuit comprises a path controlling transistor and a maintaining capacitor;

a control electrode of the path controlling transistor is electrically connected to the second gate line, a first electrode of the path controlling transistor is electrically connected to the control terminal, and a second electrode of the path controlling transistor is electrically connected to the second data line;

a first terminal of the maintaining capacitor is electrically connected to the control terminal, and a second terminal of the maintaining capacitor is electrically connected to a reference voltage input terminal.

18. The display device according to claim 16, wherein the first light-emitting sub-circuit comprises a first display control transistor;

a control electrode of the first display control transistor is electrically connected to the control terminal, a first electrode of the first display control transistor is electrically connected to the writing node, and a second electrode of the first display control transistor is electrically connected to the first light-emitting element.

19. The display device according to claim 16, wherein the second light-emitting sub-circuit comprises a second display control transistor and a third display control transistor, wherein a control electrode of the second display control transistor is electrically connected to the control terminal, and a first electrode of the second display control transistor is electrically connected to the writing node;

the control electrode of the third display control transistor is electrically connected to the second light-emitting control line, a first electrode of the third display control transistor is electrically connected to a second electrode of the second display control transistor, and a second electrode of the third display control transistor is electrically connected to the second light-emitting element.

20. The display device according to claim 16, wherein the driving circuit comprises a driving sub-circuit, a data writing sub-circuit, a light-emitting control sub-circuit, a compensation sub-circuit and an energy storage sub-circuit;

the data writing sub-circuit is electrically connected to the first gate line, the first data line and a first terminal of the driving sub-circuit, and configured for controlling to write the first data voltage into the first terminal of the driving sub-circuit under the control of the first gate driving signal;

the light-emitting control sub-circuit is electrically connected to a first light-emitting control line, a supply-voltage terminal and the first terminal of the driving sub-circuit, and configured for, under control of the first light-emitting control signal, electrically connecting the supply-voltage terminal to the first terminal of the driving sub-circuit or electrically disconnecting the supply-voltage terminal from the first terminal of the driving sub-circuit;

a first terminal of the energy storage sub-circuit is electrically connected to a control terminal of the driving sub-circuit, and a second terminal of the energy storage sub-circuit is electrically connected to the supply-voltage terminal;

a second terminal of the driving sub-circuit is electrically connected to the driving current output terminal, and the driving sub-circuit is configured for, under the control of the potential of the control terminal of the driving sub-circuit, electrically connecting the first terminal of the driving sub-circuit to the driving current output terminal or electrically disconnecting the first terminal of the driving sub-circuit from the driving current output terminal;

the compensation sub-circuit is electrically connected to the first gate line, the control terminal of the driving sub-circuit and the second terminal of the driving sub-circuit, and configured for, under the control of the first gate driving signal, electrically connecting the control terminal of the driving sub-circuit to the second terminal of the driving sub-circuit or electrically disconnecting the control terminal of the driving sub-circuit from the second terminal of the driving sub-circuit.

* * * * *